US012180663B1

(12) United States Patent
Sabella

(10) Patent No.: US 12,180,663 B1
(45) **Date of Patent: *Dec. 31, 2024**

(54) EXCREMENT REMOVER AND BAGGER COMPRISING AN EXCREMENT LIFTING MECHANISM

(71) Applicant: Sal Sabella, Coral Springs, FL (US)

(72) Inventor: Sal Sabella, Coral Springs, FL (US)

( * ) Notice: Subject to any disclaimer, the term of this patent is extended or adjusted under 35 U.S.C. 154(b) by 738 days.

This patent is subject to a terminal disclaimer.

(21) Appl. No.: 17/392,973

(22) Filed: Aug. 3, 2021

Related U.S. Application Data

(63) Continuation-in-part of application No. 17/106,543, filed on Nov. 30, 2020, now Pat. No. 11,739,483, which is a continuation of application No. 16/712,763, filed on Dec. 12, 2019, now Pat. No. 10,851,506.

(60) Provisional application No. 62/778,562, filed on Dec. 12, 2018.

(51) Int. Cl.
*E01H 1/12* (2006.01)

(52) U.S. Cl.
CPC ... *E01H 1/1206* (2013.01); *E01H 2001/1233* (2013.01); *E01H 2001/128* (2013.01)

(58) Field of Classification Search
CPC ..... E01H 1/1206; E01H 2001/1233; E01H 2001/128
See application file for complete search history.

(56) References Cited

U.S. PATENT DOCUMENTS 6,196,601 B1 * 3/2001 Juntunen, Jr. ..... E01H 1/1206 294/1.4
7,448,659 B1 * 11/2008 Auseklis ..... E01H 1/1206 294/1.4
8,196,980 B1 * 6/2012 Banks ..... E01H 1/1206 294/1.3
8,292,339 B1 * 10/2012 Auseklis ..... E01H 1/1206 294/1.4
8,967,688 B2 * 3/2015 Wilson ..... E01H 1/1206 294/1.3
10,851,506 B1 * 12/2020 Sabella ..... E01H 1/1206
11,739,483 B1 * 8/2023 Sabella ..... E01H 1/1206 294/1.3

* cited by examiner

*Primary Examiner* — Stephen A Vu
(74) *Attorney, Agent, or Firm* — John Rizvi; John Rizvi, P.A.—The Patent Professor®

(57) ABSTRACT

A sanitary excrement removal and bagging system includes a waste collector having an elongate tube for supporting a disposable bag and a retraction mechanism for drawing the disposable bag into an interior space of the elongate tube. A retraction mechanism can pull the bag into the waste collector, and a bag sealing mechanism can close the bag at discrete locations along the length of the bag forming a series of pockets capable of safely and hygienically holding dog waste or other excrements. The bag sealing member can include heating elements for heating and welding the bag to seal the pockets. A lifting mechanism may scoop the dog excrement or other waste and hold the waste in an elevated position while the bag sealing mechanism seals the pocket.

20 Claims, 32 Drawing Sheets

EXCREMENT REMOVER AND BAGGER COMPRISING AN EXCREMENT LIFTING MECHANISM

CROSS-REFERENCE TO RELATED APPLICATION

This application is a Continuation-In-Part Patent Application of U.S. patent application Ser. No. 17/106,543, filed on Nov. 30, 2020, which is a Continuation Patent Application of U.S. patent application Ser. No. 16/712,763, filed on Dec. 12, 2019, issued on Dec. 1, 2020 with U.S. Pat. No. 10,851,506, which in turn claims the benefit of U.S. Provisional Patent Application No. 62/778,562, filed on Dec. 12, 2018, all of which are incorporated-by-reference herein in their entirety.

FIELD OF THE INVENTION

The present invention relates generally to dog waste or other excrement removal devices, and more particularly, to a device to remove individual portions of dog waste or other excrements and seal the portions of dog waste or excrement into individual packets formed within a flexible bag for subsequent disposal.

BACKGROUND OF THE INVENTION

Many people keep pets such as dogs and cats for companionship and protection. However, like any living creature, dogs and cats excrete waste, management and disposal of which is cumbersome and time consuming for dog and cat owners. While cats can be trained to deposit their wastes in special indoor containers, dogs typically need to be walked so they can perform their excretory functions outside. While this may not pose a problem in more rural areas, in more populated areas it is desirable and often required by law that the dog owners pick up their dogs' excretory deposits. Failure to do so can result in unsightly and odorous messes and even tines.

Many devices have been developed for scooping tip the excreted waste with shovel or rake type devices and using them to deposit the waste into disposable bags. Unfortunately, however, this can be difficult to do often resulting in dropped wastes and dirtied disposal bags. Alternatively, dog owners may manually pick up dog excrement donning a disposable bag on their hand similarly to a glove, scooping the excrement, and finally inverting the bag inside out to place the excrement inside the bag. While this action seems simple, it may be difficult to execute with larger excrement portions and may result in the user's hand, clothing and/or the outside of the disposable bag becoming soiled. Additionally, since a dog may perform the excretory functions several times during a walk, the owner needs to carry multiple bags.

Accordingly, there remains a need in the art for a solution to at least one of the aforementioned problems. For example, there is an established need for a simple and sanitary device or utensil that can successfully pick up excrements from the ground. It is also desirable to reduce the number of disposable bags required to pick up multiple excrements.

SUMMARY OF THE INVENTION

The present invention is directed to a convenient and sanitary excrement removal and bagging system that is capable of collecting multiple, individual portions of dog waste and storing them within separate sealed packets of a flexible elongate bag. The excrement removal and bagging system includes a disposable bag and a waste collector including an elongate tube for supporting the disposable bag and a retraction mechanism for drawing the disposable bag into an interior space of the elongate tube. A retraction mechanism can pull the bag into the waste collector. As the bag is pulled into the waste collector, a bag sealing mechanism can close the bag at discrete locations along the length of the bag forming a series of pockets capable of safely and hygienically holding excrements. In some embodiments, the bag sealing member can include heating elements for heating and welding the bag to seal the pockets. Alternatively or additionally, the bag sealing member can include an elastic band. In some embodiments, a lifting mechanism can lift or "scoop" the excrement into the bag and hold the excrement in an elevated position prior to the bag sealing mechanism forming the sealed closure, preferably preventing any fluids or solids from falling towards the sealing mechanism during the heating and welding phase.

In a first implementation of the invention, an electrically-powered excrement remover and bagger may comprise a hollow elongate tube having an interior space, a proximal end, and an open distal end. The tube may be configured to removably receive a flexible elongate bag in the interior space, with a proximal end of the bag arranged within the interior space and an open, distal end of the bag folded over and arranged outside the tube. The excrement remover and bagger may further include a retraction mechanism comprising a flexible elongated element, a clamp at a distal end of the flexible elongated element, and a pulling mechanism configured to pull the flexible elongated element and clamp towards a proximal end of the tube. The clamp may be configured to removably engage the proximal end of the bag. The excrement remover and bagger may further include a lifting mechanism and a bag sealing mechanism. The lifting mechanism may be configured to scoop an excrement off the ground and into the bag. The bag sealing mechanism may be configured to form a sealed closure in the bag. The excrement remover and bagger may be switchable between a first configuration and a second configuration. In the first configuration, the lifting mechanism may define an end opening for receiving the excrement into an internal space of the lifting mechanism, and the bag sealing mechanism may be arranged in a non-sealing position. In the second configuration, the lifting mechanism may be arranged vertically higher than the bag sealing mechanism and may hold the excrement within the internal space of the lifting mechanism; furthermore, the bag sealing mechanism may be arranged in a sealing position to form the sealed closure and create a sealed pocket along the bag for holding the excrement therein.

In a second aspect, the pulling mechanism may be configured to pull the flexible elongated element and clamp towards the proximal end of the tube at discrete intervals. The excrement remover and bagger may be repetitively and reversibly switchable between the first and second configurations as the bag is pulled into the interior space of the tube by the retraction mechanism at the discrete intervals, to create a respective sealed pocket at each interval of the discrete intervals.

In another aspect, the bag sealing mechanism may include two sealing members movably arranged facing one another and carrying respective heating elements. The sealing members may be configured to move between the non-sealing position, in which the heating elements may be spaced apart from one another, and the sealing position, in which the heating elements may be arranged adjacent one another.

In another aspect, the sealing members may be located at the open distal end of the tube.

In another aspect, in the non-sealing position, the heating elements may be arranged radially outward of the lifting mechanism relative to a central longitudinal axis of the tube.

In yet another aspect, the lifting mechanism may include a pair of jaws. The jaws may be pivotable relative to one another between an open position in which respective bottom ends of the jaws may define the end opening of the lifting mechanism, and a closed position in which the bottom ends of the jaws may be adjacent one another. The jaws may be arranged in the open position and the closed position when the excrement remover and bagger is in the first configuration and the second configuration, respectively.

In another aspect, the bottom ends of the jaws may be configured to fluid-tightly abut opposite sides of the bag onto one another when the jaws are arranged in the closed position.

In another aspect, the bottom ends of the jaws may comprise an undulating contour.

In another aspect, the jaws may be pivotably connected to one another about a jaw pivoting axis, and the jaws and jaw pivoting axis may be vertically movable relative to the tube. The lifting mechanism in the first configuration may be arranged vertically lower than in the second configuration.

In yet another aspect, the bag sealing mechanism may include two sealing members movably arranged facing one another and comprising respective heating elements configured to weld opposite sides of the bag to one another to form the sealed closure. Each sealing member may be articulately connected to a respective jaw of the pair of jaws such that a pivoting of the jaws towards the closed position causes a movement of the respective heating elements towards one another and towards the sealing position.

In another aspect, the sealing members and the bottom ends of the jaws may be located at the open distal end of the tube.

In another aspect, each sealing member may be articulately connected to the respective jaw by a respective sealing member link. Each sealing member link may include a first articulate connection between said each sealing member link and the respective jaw and a second articulate connection between said each sealing member link and said each sealing member. Each sealing member link may be configured to convert a pivoting movement of the respective jaw to a transverse translation of said each sealing member.

In another aspect, each sealing member may include at least one roller configured to roll along a respective transverse track formed in the tube. The second articulated connection may articulately connect the at least one roller to said each sealing member link.

In yet another aspect, the tube may include an outer skirt at the open distal end. The skirt may include a generally flat underside configured to stably rest on a flat surface. The transverse tracks may be comprised in the skirt.

In another aspect, the jaws may be pivotably connected to one another about a jaw pivoting axis, and the jaws and jaw pivoting axis may be vertically movable relative to the tube. The lifting mechanism in the first configuration may be arranged vertically lower than in the second configuration. The excrement remover and bagger may further include a guide, the guide comprising a vertical slot configured to vertically guide the jaw pivoting axis.

In another aspect, the excrement remover and bagger may further include a pair of jaw links. The jaw links may be articulately connected to one another about a rotation axis arranged in vertical registration and below the jaw rotation axis. Each jaw link may be further articulately connected to a respective jaw of the pair of jaws by a respective articulate connection.

In another aspect, the guide may further include a pair of L-shaped slots. Each L-shaped slot may comprise a generally transverse, first segment, and a generally longitudinal, second segment extending from the first segment, each L-shaped slot configured to guide the respective articulate connection between a respective jaw of the pair of jaws and a respective jaw link of the pair of jaw links.

In yet another aspect, the first segment may be sloped towards the jaw rotation axis, and the second segment may be sloped towards a central longitudinal axis of the tube.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a convenient and sanitary excrement remover and bagger that is capable of collecting, bagging and storing multiple portions of dog wastes or other excrements in a disposable bag for subsequent disposal.

Figure 1:
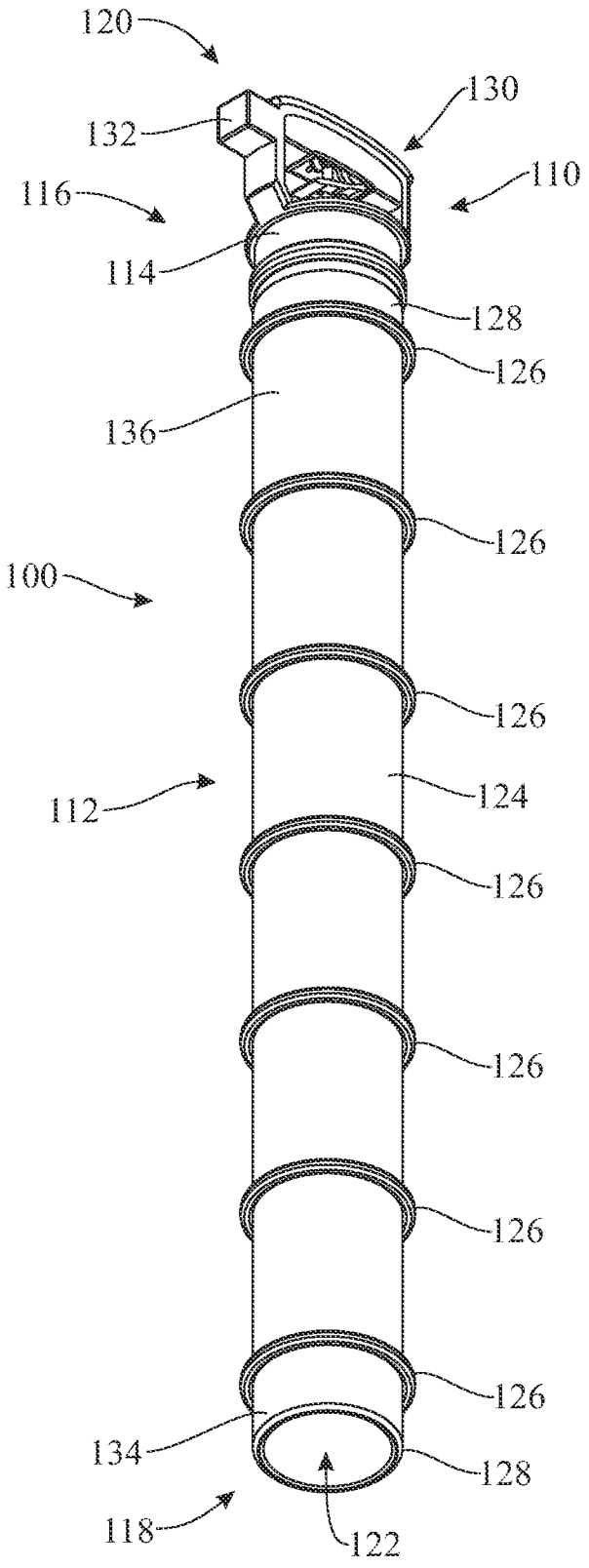
FIG. 1 presents a bottom, side isometric view showing a first illustrative embodiment of an excrement remover and bagger of the present invention.
Figure 2:
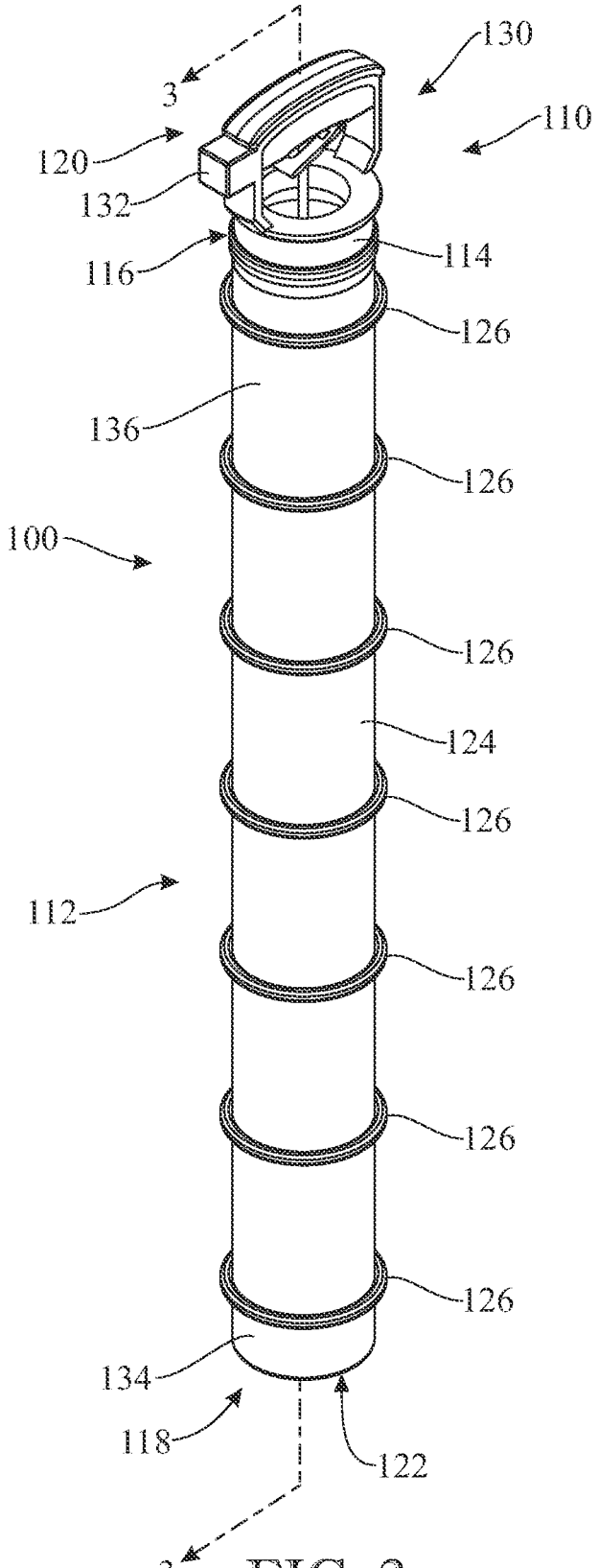
FIG. 2 presents a top, side isometric view of the first embodiment of the excrement remover and bagger of the present invention.

Referring to FIGS. 1-5, and initially with regard to FIGS. 1 and 2, an excrement remover and bagger 100 is illustrated in accordance with a first embodiment of the present invention, configured as a manually-actuated doge waste collection system. As shown, the excrement remover and bagger 100 generally includes a waste collector 110 having a removable and disposable bag 112 disposed about the waste collector 110. The waste collector 110 is provided to be positioned over a portion of dog waste for removal and includes a rigid, elongate tube 114 having a rear or proximal end 116 and a front or open distal end 118. A control head 120 is mounted on the proximal end 116 of the tube 114 and is operable to draw the disposable bag 112 into an interior space 122 of the tube 114 in a manner described in more detail hereinbelow.

The disposable bag 112 is provided to cover and store individual portions of dog waste and secure the portions in individual sections or packets of the disposable bag 112. This permits the excrement remover and bagger 100 to be used multiple times during a person's daily walks with their dog to pick up the waste portions as they are deposited on the ground by the dog. The disposable bag 112 is formed as a flexible elongate sleeve 124 having a plurality of circumferential, securing elastic bands 126 embedded into the flexible elongate sleeve 124 at discrete, spaced apart positions along the length of the flexible elongate sleeve 124. The disposable bag 112 is removably and slidably positioned over an outer surface 128 of the tube 114 of the waste collector 110. The elastic bands 126 are contractible from a stressed or stretched condition around the outer surface 128 of the tube 114 to a substantially smaller diameter or contracted condition when pulled off of the tube 114 to secure and seal individual sections of the flexible elongate sleeve 124 containing dog wastes.

The control head 120 includes a retraction mechanism 130 located in a control head housing 132 of the waste collector 110. The control head housing 132 is mounted to the rear or proximal end 116 of the tube 114 and the retraction mechanism 130 is provided to engage and draw the disposable bag 112 into the interior space 122 of the tube 114 as portions of dog waste are collected. The elastic bands 126 incorporated into the flexible elongate sleeve 124 of the disposable bag 112 allow the disposable bag 112 to be sectioned or cordoned off into the individual packets as individual portions of dog waste are collected. The flexible elongate sleeve 124 has a first or closed distal end 134 and a second or open proximal end 136 and defines an interior space 138, when inverted (see FIG. 3), to capture and secure dog waste.

The disposable bag 112 including the flexible elongate sleeve 124 and the elastic bands 126 may be formed from a variety of disposable and/or biodegradable materials for safe and environmentally friendly disposal after use. The tube 114 may be formed from a variety of materials including polymers and plastics or metallic materials such as stainless steels for easy cleaning and sterilization after use. The housing 132 of the control head 120 may also be formed from a variety of polymer or plastic materials, metallic materials, etc.

Figure 3:
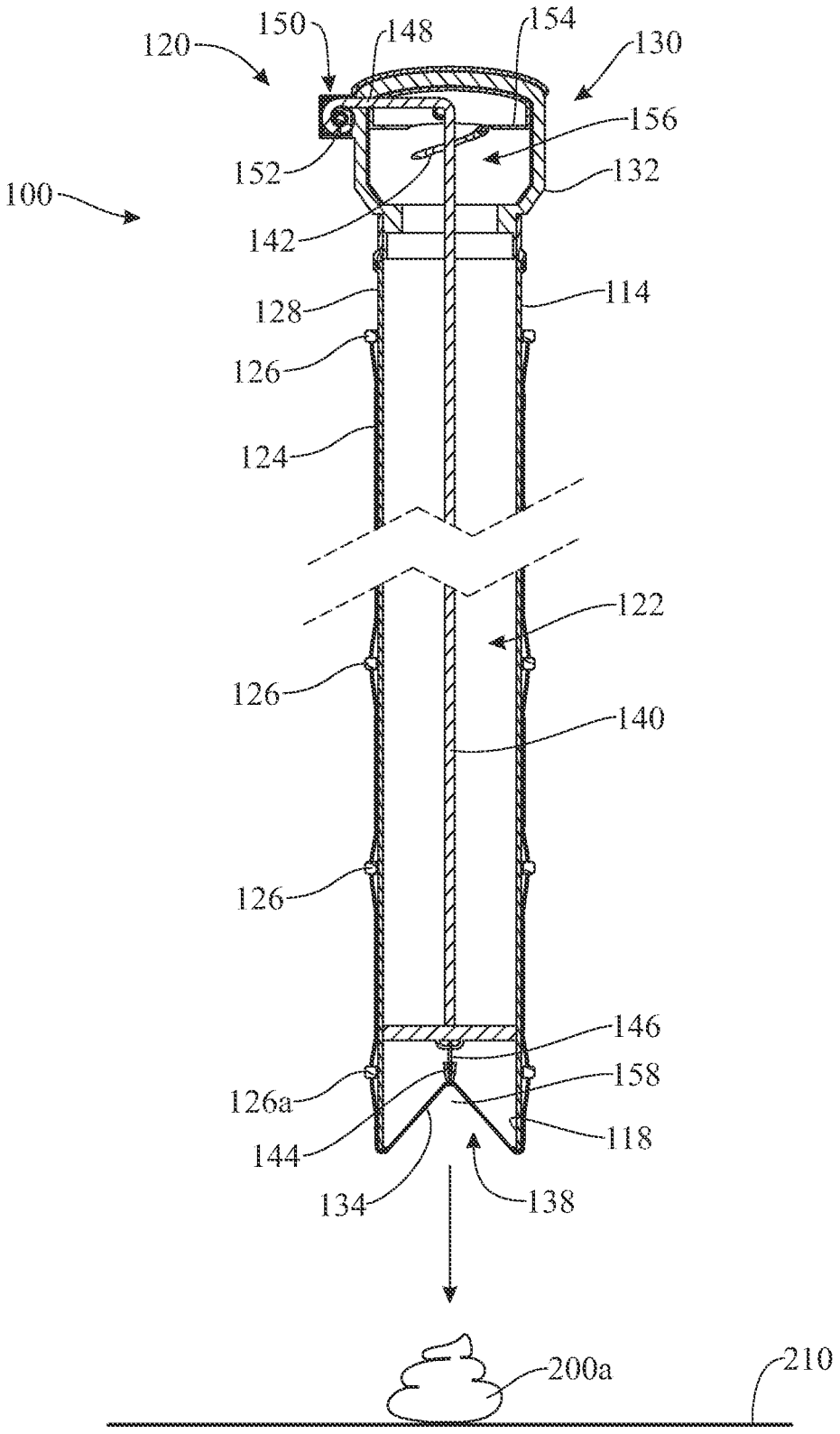
FIG. 3 presents a cross-sectional view, taken along line 3-3 of FIG. 2, of the first embodiment of the excrement remover and bagger of the present invention positioned over a piece of excrement to be removed and bagged.

Turning now to FIG. 3, the retraction mechanism 130 generally includes a flexible elongated element, such as, but not limited to, a wire or cable 140, and a trigger 142 to actuate and retract the wire or cable 140 within the interior space 122 of the tube 114. The cable 140 is provided to engage and draw the distal end 124 of the flexible elongate sleeve 124 into the interior space 122 of the tube 114. The cable 140 is removably attached to the flexible elongate sleeve 124 and includes a releasable clamp 144 at a distal end 146 of the cable 140 for removably engaging the distal end 134 of the flexible elongate sleeve 124. A proximal end 148 of the cable 140 is connected to the trigger 142 such that movement or actuation of the trigger 142 draws the cable 140 proximally within the tube 114. This allows the cable 140 to progressively draw the flexible elongate sleeve 124 into the interior space 122 of the tube 114.

In order to prevent the cable 140 from relaxing or slipping distally within the tube 114, and thus possibly releasing dog waste prior to being secured within the flexible elastic sleeve 124 with the elastic bands 126, the retraction mechanism 130 further includes a cable tensioner mechanism 150. The cable tensioner mechanism 150 is mounted in the control head 120 and includes a spring-loaded cable winder 152 connected to the proximal end 148 of the cable 140. The spring-loaded cable winder 152 tensions the cable 140 proximally within the tube 114 and may be formed from a coil spring, shape memory sheet of material, etc.

As shown, the trigger 142 is pivotally mounted on a bracket 154 extending into an interior 156 of the control head housing 132 and includes a hole, notch or other feature that releasably engages the cable 140 such that actuation or proximal movement of the trigger 142 engages and draws proximally the cable 140 and release of the trigger 142 disengages the trigger 142 from the cable 140 and allows the trigger 142 to reengage the cable 140 further along the length of the cable 140. As noted above, the cable tensioner mechanism 150 maintains proximal tension on the cable 140 while the trigger 142 is being released for a subsequent actuation.

With reference now to FIGS. 1 and 3-5, the use of the excrement remover and bagger 100 to collect and temporarily store a plurality of dog waste deposits 200*a*, 200*b*, etc. will now be described. Initially with regard to FIG. 1, the excrement remover and bagger 100 is prepared for use by positioning the disposable bag 112 onto the waste collector 110 by sliding the disposable bag 112 over the tube 114 of the waste collector 110 and stretching the elastic bands 126 such that the elastic bands 126 embedded in the flexible elongate sleeve 124 are at spaced apart locations on the tube 114. The closed distal end 134 of the flexible elongate sleeve 124 is positioned over the open distal end 118 of the tube 114.

As shown in FIG. 3, the releasable clamp 144 of the retraction mechanism 130 is affixed to the closed distal end 134 of the flexible elastic sleeve 124 and the trigger 142 of the retraction mechanism 130 is actuated to draw the distal end 134 into the interior space 122 of the tube 114. As the flexible elastic sleeve 124 is drawn into the tube 114 it is inverted to form the interior space 138 described hereinabove. This inversion of the flexible elastic sleeve 124 forms a "pocket" 158 in the interior space 138 of the disposable bag 112, adjacent the distal end 118 of the tube 114 for receipt of an initial dog waste deposit 200*a*.

In use, the excrement remover and bagger 100 is positioned over a dog waste deposit 200*a* and advanced down over the dog waste deposit 200*a* such that the dog waste deposit 200*a* is covered by the flexible elastic sleeve 124. Specifically, the dog waste deposit 200*a* enters the pocket 158 formed in the interior space 138 of the flexible elongate sleeve 124.

Figure 4:
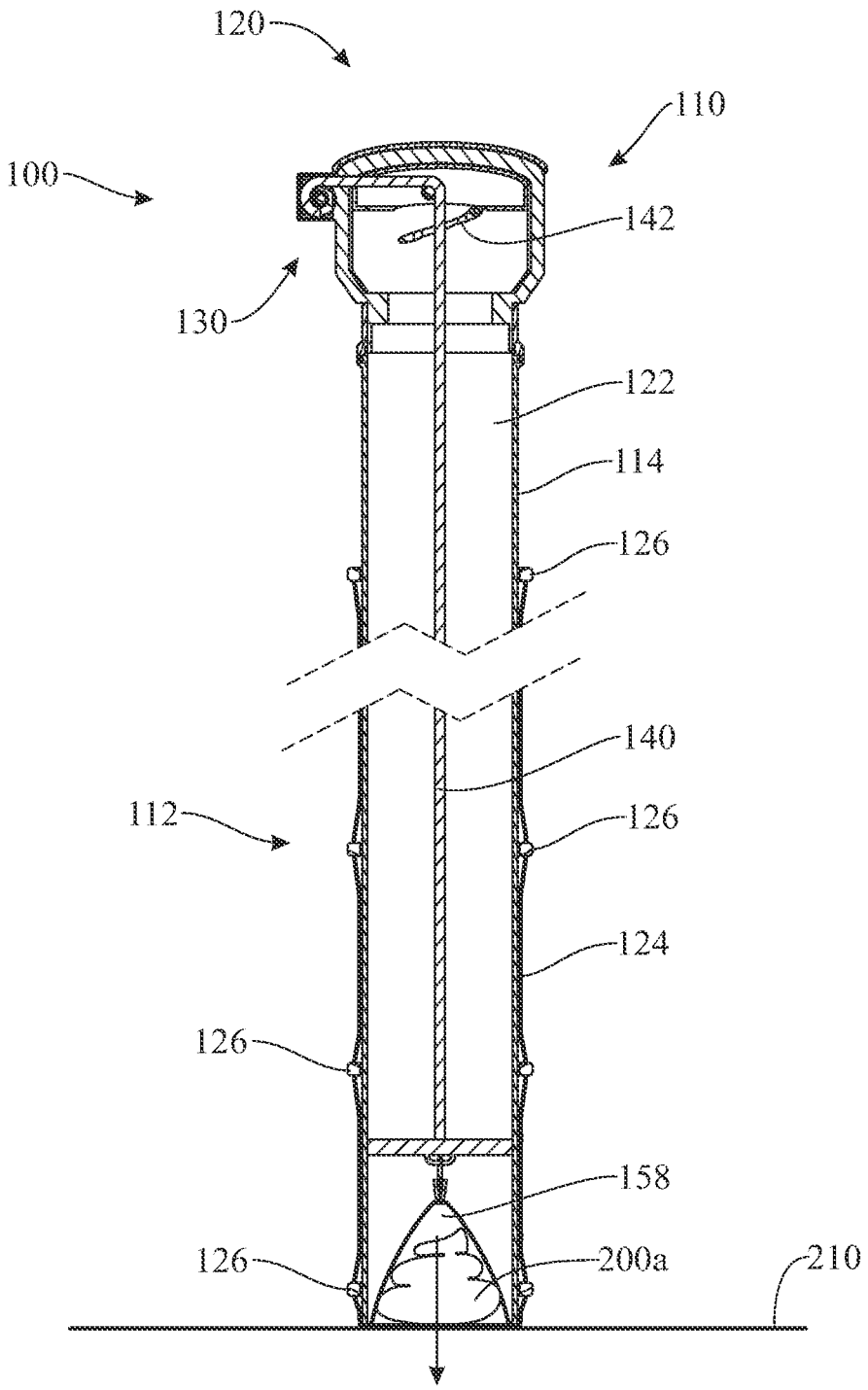
FIG. 4 presents a view similar to FIG. 3 with an open end of the first embodiment of the excrement remover and bagger of the present invention covering the piece of excrement to be removed and bagged.
Figure 5:
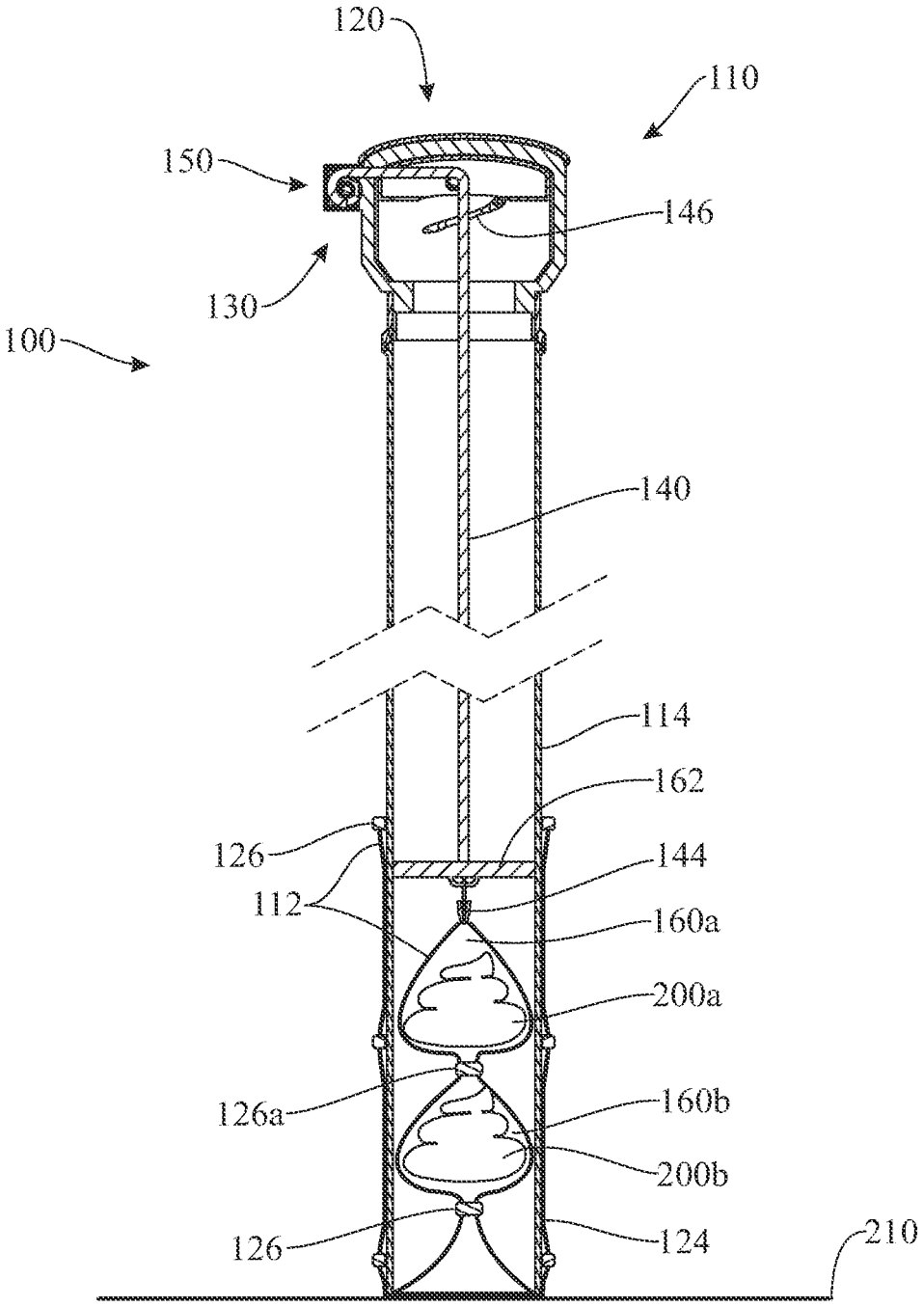
FIG. 5 presents a view similar to FIG. 4 after the first embodiment of the excrement remover and bagger of the present invention has been actuated to capture and secure several pieces of increment in a continuous bag of the excrement remover and bagger.

Referring to FIG. 4, the excrement remover and bagger 100 is advanced down over the dog waste deposit 200*a* until the distal end 118 of the tube 114 engages the ground 210 or other surface upon which the dog waste deposit 200*a* is deposited. Once the dog waste deposit 200*a* has been completely covered and the distal end 118 pressed onto the ground 210, the trigger 142 can be actuated to initially retract the cable 140 and draw the flexible elongate sleeve 124 upwardly within the interior 122 of the tube 114. As the flexible elongate sleeve 124 is drawn upwardly through the interior 122, the flexible elongate sleeve 124 is simultaneously drawn downwardly along the outer surface 128 of the tube 114 thereby drawing and sequentially advancing the elastic bands 126 embedded in the flexible elongate sleeve 124 toward the distal end 118 of the tube 114. Once the elastic bands 126, for example elastic band 126*a*, has passed over the distal end 118 of the tube 114, the elastic band is released from the stressed or expanded condition and collapses or contracts to the condition drawing the flexible elongate sleeve closed about the dog waste deposit 200*a*. Contraction of the elastic band 126*a* "scoops" up the dog waste deposit 200*a* into the pocket 158 to form a sealed "packet" 160*a* of dog waste (FIG. 5).

The process may be repeated with additional dog waste deposits 200*b*, etc. to form additional dog waste packets 160*b*, etc. Once the walk has been completed, the disposable bag 112 filled up or the operator simple wishes to dispose of the collected waste in the accumulated packets 160*a*, 160*b*, etc., the trigger 146 is actuated until a last or final elastic band 126 passes over the distal end 118 of the tube 114 or the operator simply pulls the remaining elastic bands and associated elongate sleeve 124 of the disposable bag 112 off of the tube 114. Thereafter, the clamp 144 may be released from the disposable bag 112 and the now filled disposable bag 112 disposed of properly.

It should be noted that, during the retraction process, the tensioner mechanism 150 maintains the now filled packets 160*a*, 160*b*, etc. upwardly within the tube 114 until released by the clamp 144 to prevent the packets 160*a*, etc. from falling out of the excrement remover and bagger 100. It should also be noted that, the retraction mechanism 130 may additionally include a stabilizing plate 162 adjacent the clamp 144. The stabilizing plate 162 keeps the clamp 144 at the distal end 146 of the cable 140, and thus the distal end 134 of the flexible elongate sleeve 124, centered within the interior space 122 of the tube 114 to maintain the size of the pocket 158.

Thus, in this manner, the disclosed excrement remover and bagger 100 provides a convenient and sanitary of removing and collecting dog waste for subsequent disposal.

Figure 6:
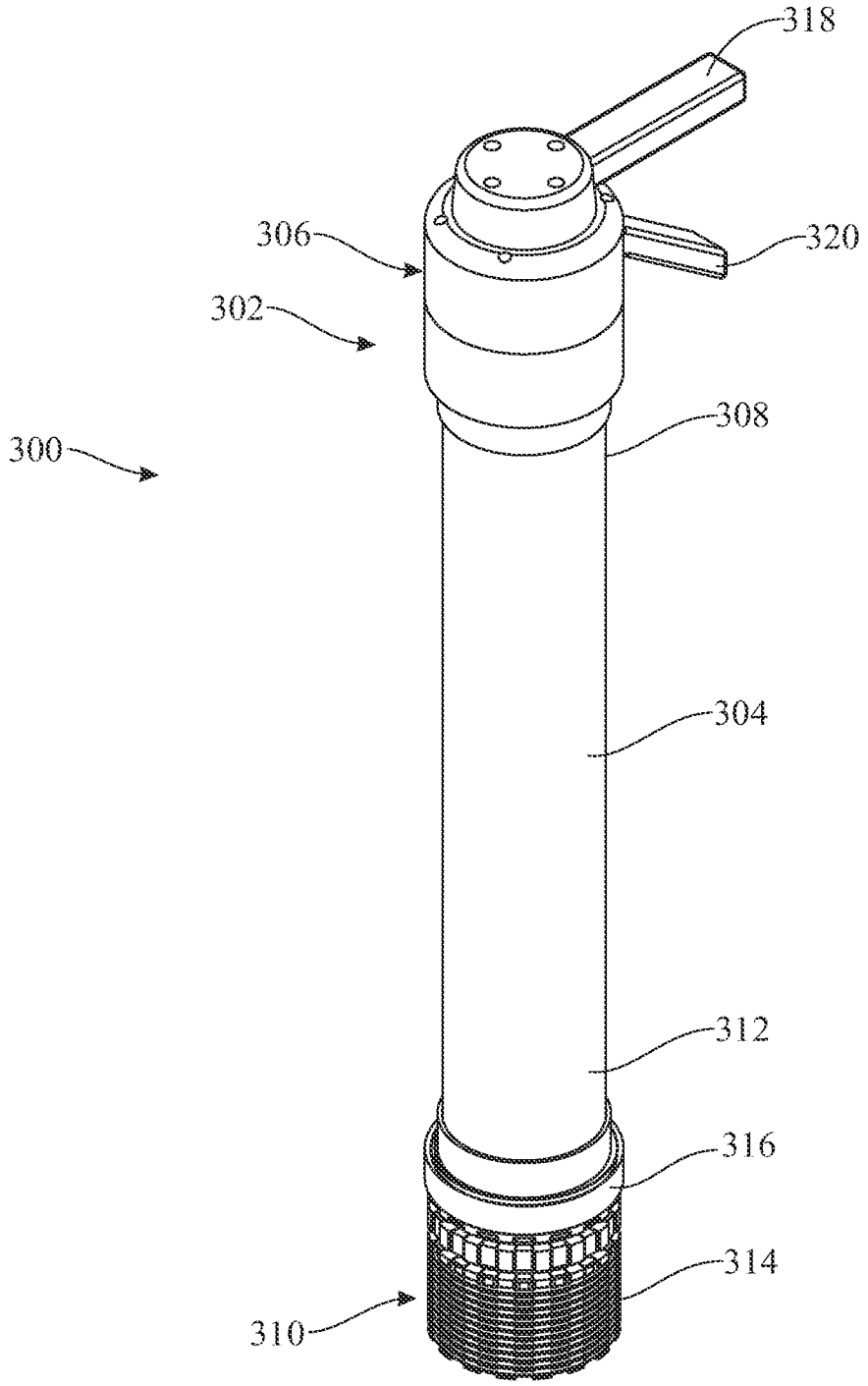
FIG. 6 presents a top, side isometric view of a second illustrative embodiment of an excrement remover and bagger of the present invention.
Figure 7:
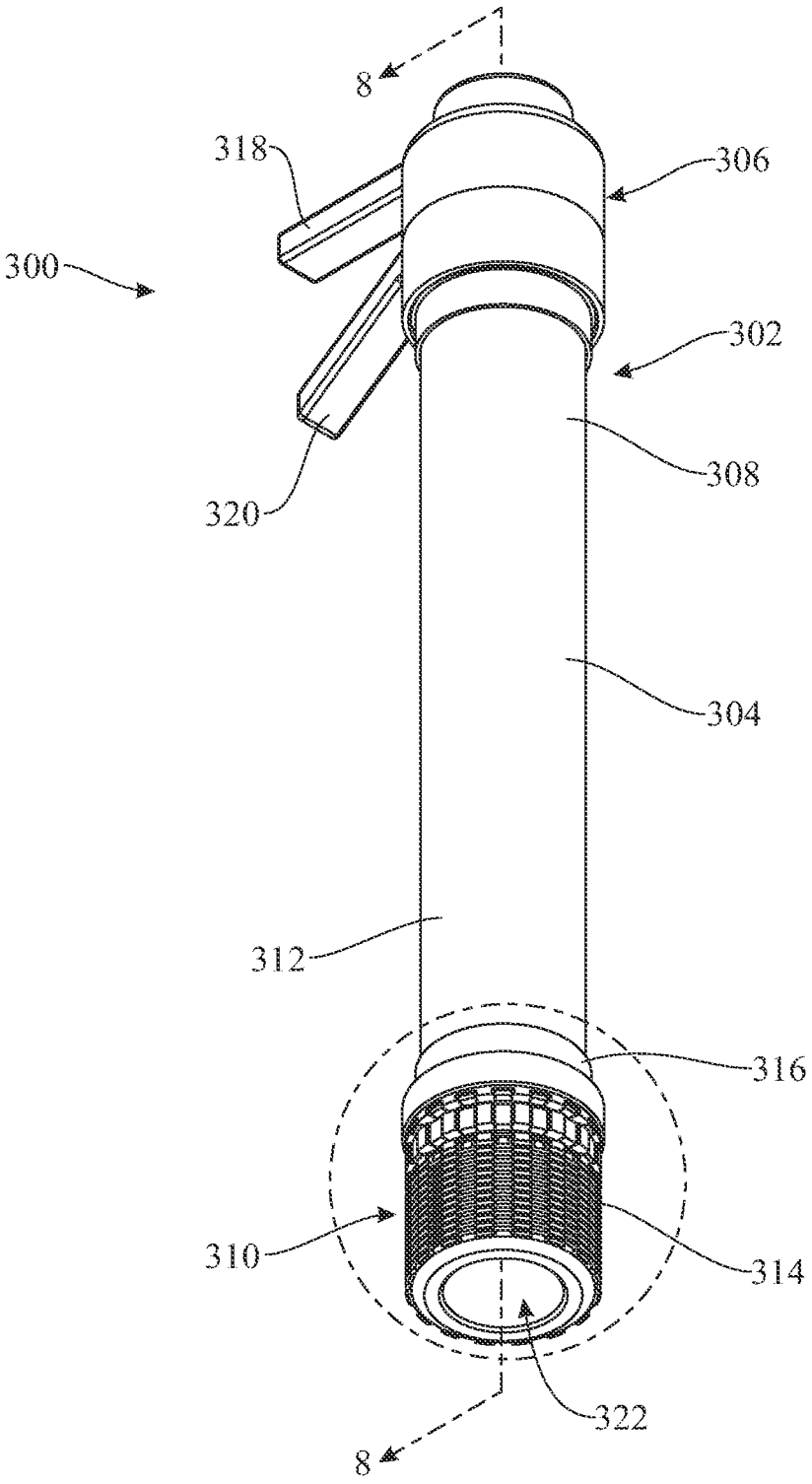
FIG. 7 presents a bottom, side isometric view of the second embodiment of the excrement remover and bagger of the present invention.

Turning now to FIGS. 6-13, and initially with regard to FIGS. 6 and 7, there is illustrated an excrement remover and bagger 300 in accordance with a second embodiment of the present invention configured as a manually-actuated dog waste collecting system incorporating sequentially advancing elastic closing bands. The excrement remover and bagger 300 generally includes a waste collector 302 including a hollow tube 304 and a control head 306 mounted on a rear or proximal end 308 of the hollow tube 304. In this embodiment, the waste collector 302 includes a replaceable band cartridge 310 removably mounted on a front or open distal end 312 of the hollow tube 304. The replaceable band cartridge 310 is provided to retain a plurality of elastic bands 314 and sequentially move the elastic bands 314 towards the open distal end 312 of the hollow tube 304 for securement about a bag as discussed in more detail hereinbelow.

Figure 11:
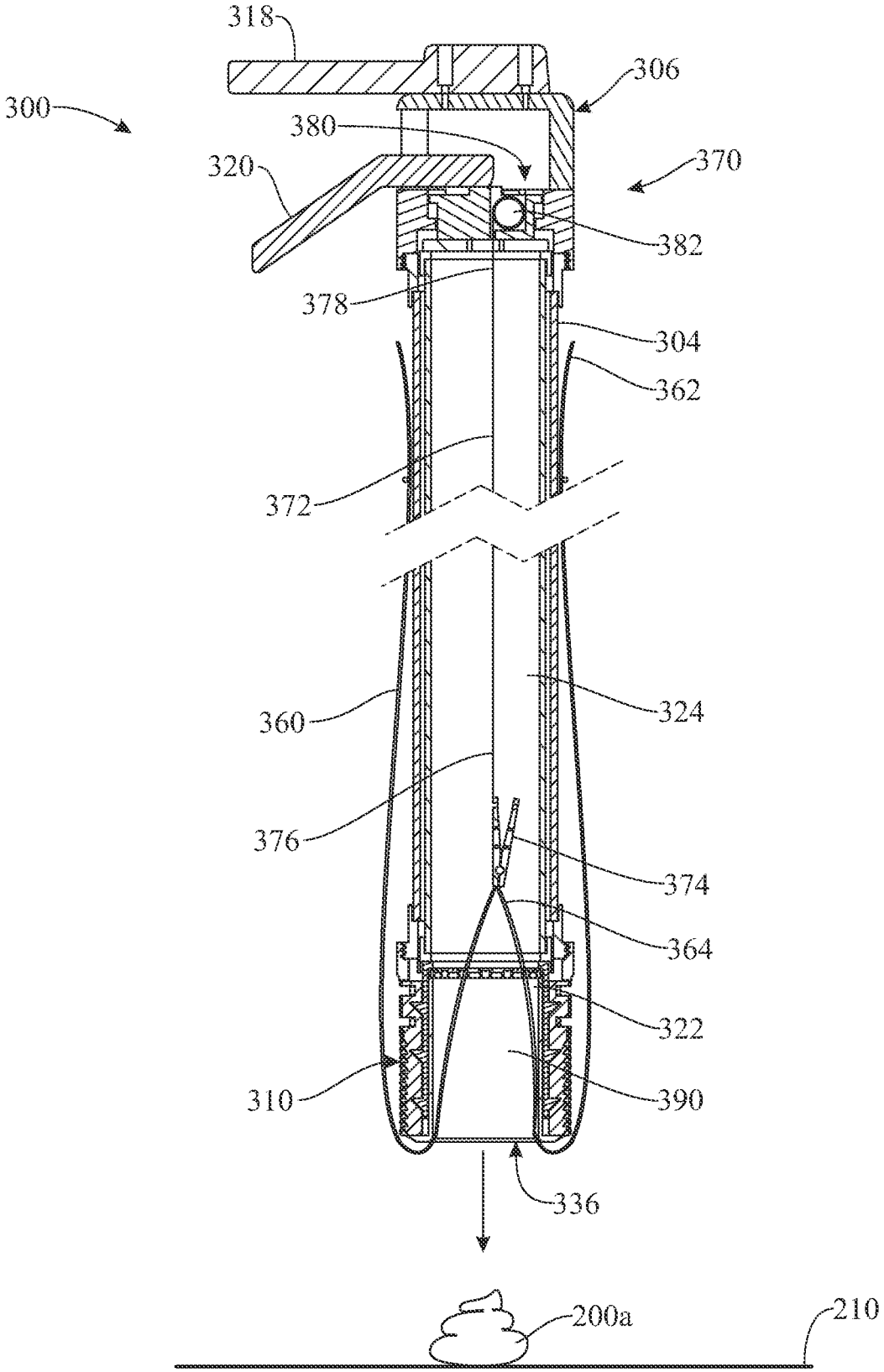
FIG. 11 presents a presents a cross-sectional view of the second embodiment of the excrement remover and bagger of the present invention positioned over a piece of excrement to be removed and bagged.

The control head 306 includes a fixed handle 318 and a movable trigger 320. The movable trigger 320 functions similarly to the trigger 142 discussed above to retract a bag initially through an interior space 322 of the band cartridge 310 and subsequently up into an interior space 324 of the hollow tube 304 (FIG. 11).

Figure 8:
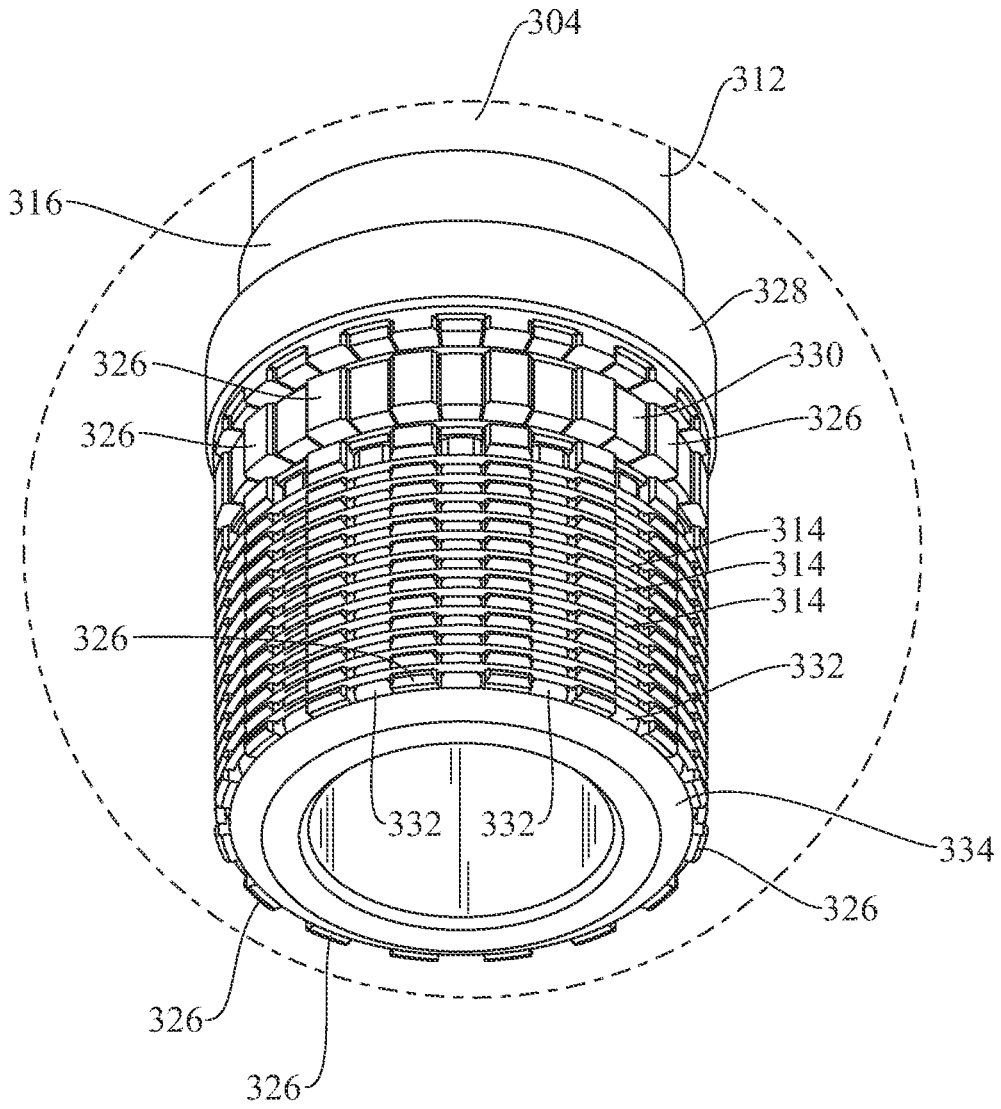
FIG. 8 presents an enlarged area of detail view of FIG. 7 showing a band cartridge of the second embodiment of the excrement remover and bagger of the present invention adjacent a bottom or distal opening of the excrement remover and bagger.

Referring to FIG. 8, the replaceable band cartridge 310 is provided with a plurality of longitudinal series of fixed teeth 326 extending from a housing 328 of the replaceable band cartridge. The plurality of elastic bands 314 are initially supported on the longitudinal series of fixed teeth 326. The replaceable band cartridge 310 also includes a movable circumferential plate 330 having a plurality of longitudinal series of movable teeth 332. Each of the plurality of the longitudinal series of movable teeth 332 are positioned between the plurality of longitudinal series of fixed teeth 326, i.e. each longitudinal series of fixed teeth 326 are separated by one of the longitudinal series of movable teeth 332. The longitudinal series of movable teeth 332 rest beneath the plurality of elastic bands 314 prior to actuation of the band cartridge 310. The replaceable band cartridge 310 further includes a cylindrical triggering plate 334 which, when actuated, forces the longitudinal series of movable teeth 332 radially outwardly to lift the elastic bands 314 off of the longitudinal series of fixed teeth 326 and move the elastic bands 314 forward a distance of one tooth on the longitudinal series of fixed teeth 326 as discussed below.

Figures 9A, 9B, 9C:
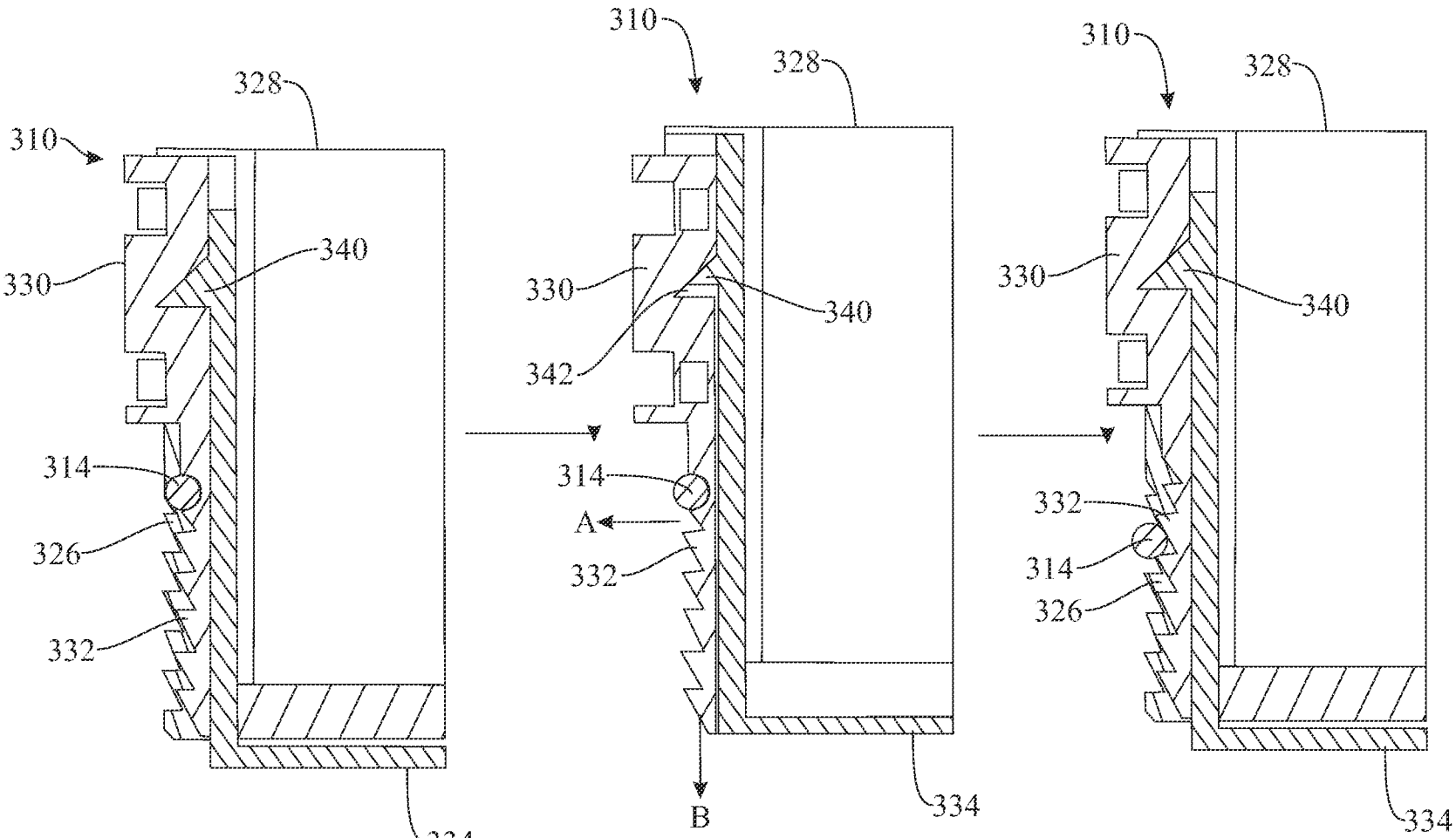
FIG. 9*a-c* presents a first series of cross-sectional views of the band cartridge of the second embodiment of the excrement remover and bagger of the present invention illustration operation of the excrement remover and bagger and band cartridge to advance a securing band of the excrement remover and bagger towards the distal opening.

Turning now to FIGS. 9*a*-9*c* and 10*a*-10*c*, and initially with regard to FIG. 9*a*, the operation of the replaceable band cartridge 310 to advance the elastic bands 314 towards and over a distal end 336 of the replaceable band cartridge 310 of the waste collector 302 will now be described. Initially, the elastic band 314 rests on the longitudinal series of fixed teeth 326, the movable circumferential plate 330 and the longitudinal series of movable teeth 332 are in a contracted condition and the triggering plate 334 is in a distal most position.

Turning to FIG. 9*b*, to actuate the band cartridge 310, the entire waste collector 302 (FIG. 7) is pressed against a surface such that the triggering plate 334 is driven proximally relative to the movable circumferential plate 330. As the triggering plate 334 moves proximally, an outwardly extending angled projection 340 on the triggering plate 334 engages a similarly shaped, angled recess 342 in the movable circumferential plate 330 to drive the movable circumferential plate 330 and, more particularly, the plurality of longitudinal series of movable teeth 332 outwardly relative to the plurality of longitudinal series of fixed teeth 326 to thereby lift the elastic band 314 up and outwardly in the direction of arrow "A". Additionally, the proximal motion of the triggering plate 334 drives the movable circumferential plate 330 slightly distally in the direction of arrow "B". As the movable circumferential plate 330 moves distally, the elastic band 314, now carried by the longitudinal series of movable teeth 332, is also advanced slightly distally.

When the pressure is released from the triggering plate 334 by withdrawing the waste collector 302 away from the ground, the longitudinal series of movable teeth 332 contract and allow the elastic band 314 drop down onto a more distal tooth or portion of the longitudinal series of fixed teeth 326. The movable circumferential plate 330 and plurality of longitudinal series of movable teeth 332 return to their initial position (FIG. 9*c*).

Figure 10C:
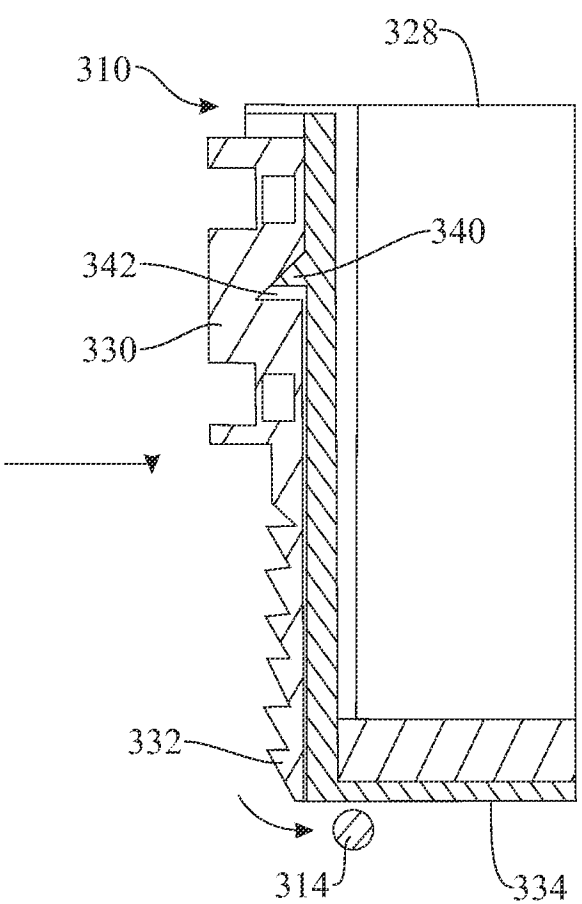
FIG. 10*a-c* presents a view similar to FIG. 9 illustrating a second series of cross-sectional views illustrating movement of the securing band off the band cartridge and across the distal opening.
Figure 10B:
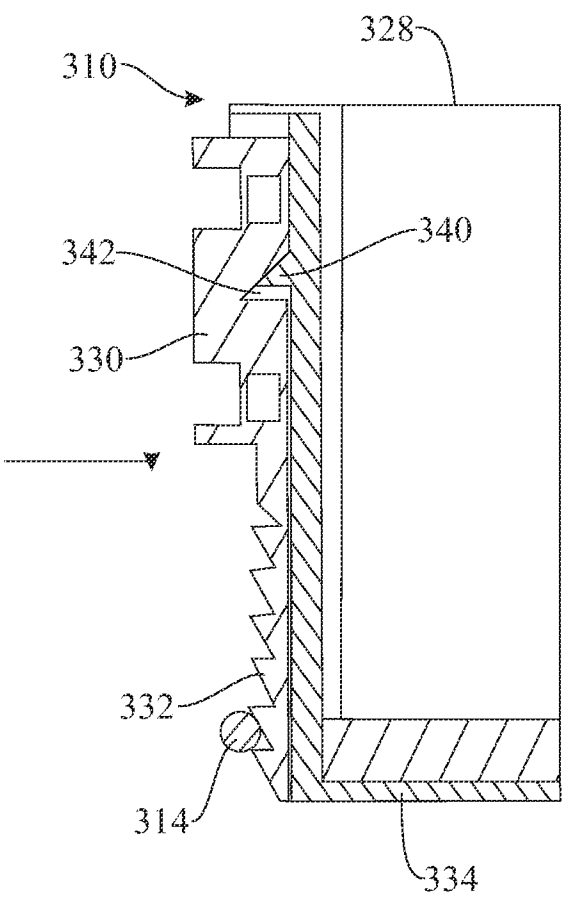
Figure 10A:
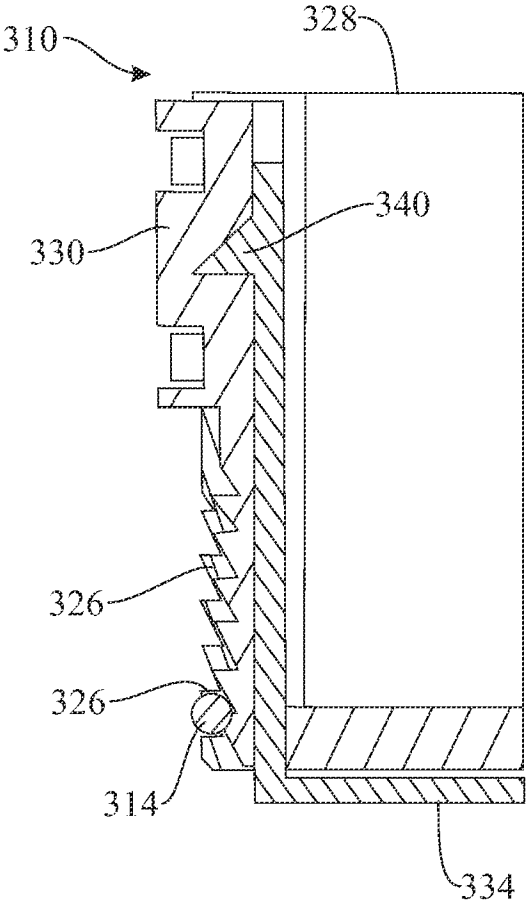

As best shown in best shown in FIGS. 10*a*-10*c*, repeated actuations of the waste collector 302 by depressing the triggering plate 334 against a surface sequentially advances the elastic band(s) 314 distally along the longitudinal series of fixed teeth 326 until the elastic band 314 is advanced distally off the end of the last tooth 344 of the longitudinal series of movable teeth 332 replaceable band cartridge 310 (FIG. 10).

Figure 12:
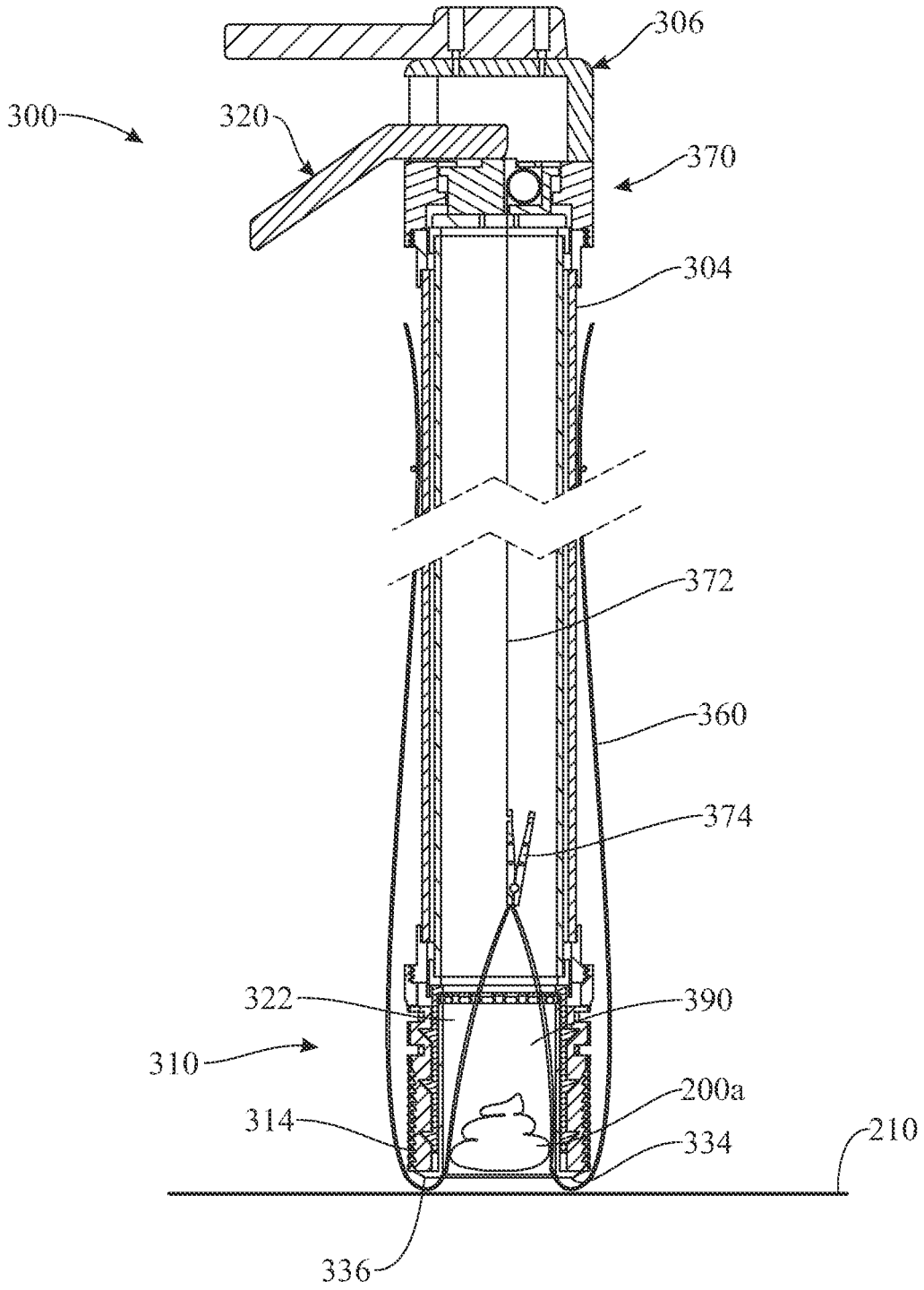
FIG. 12 presents a view similar to FIG. 11 with the open distal end of the second embodiment of the excrement remover and bagger of the present invention covering the piece of excrement to be removed and bagged.
Figure 13:
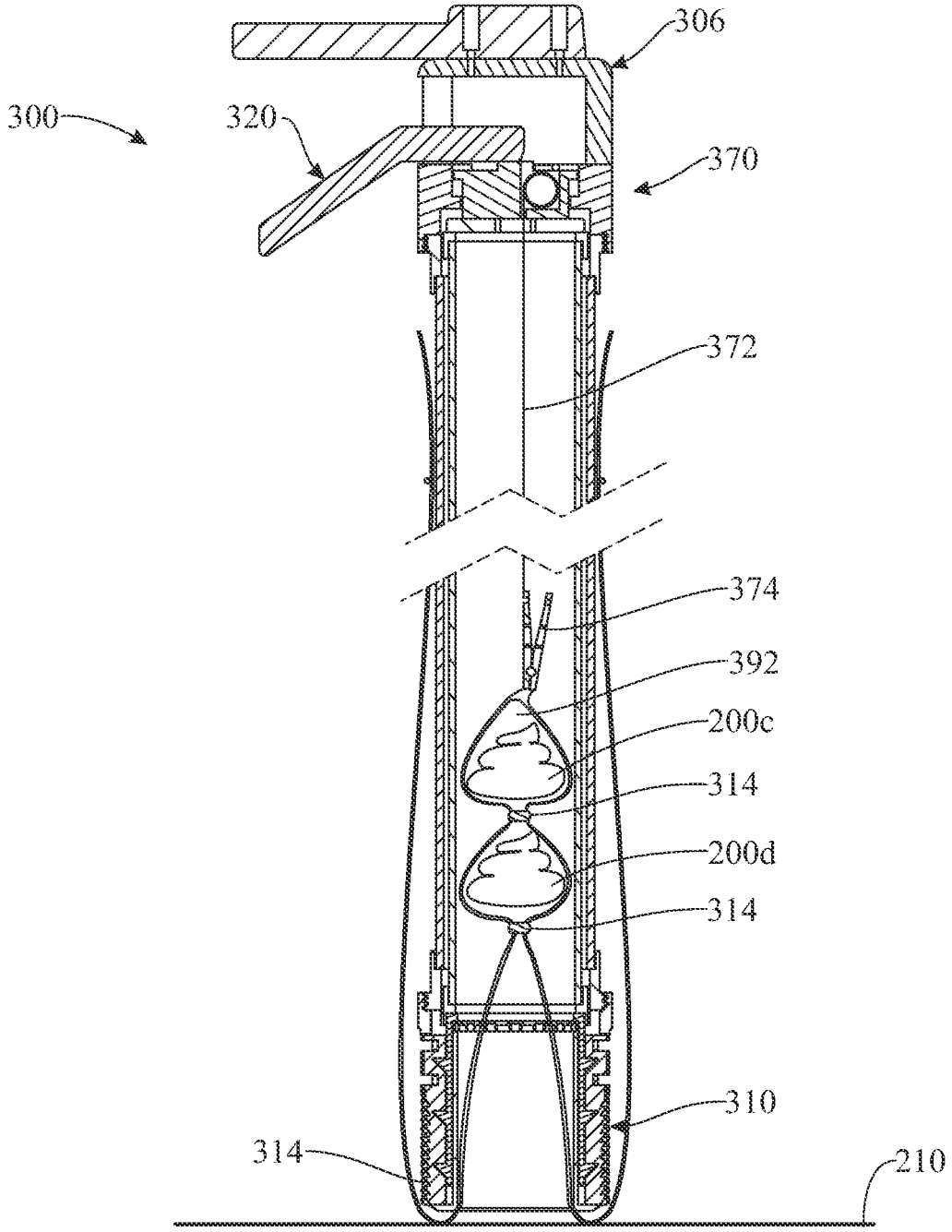
FIG. 13 presents a view similar to FIG. 12 after the second embodiment of the excrement remover and bagger of the present invention has been actuated to capture and secure several pieces of increment within a continuous bag of the excrement remover and bagger and secured by the securing bands.

Referring now to FIGS. 11-13, and initially with regard to FIG. 11, the excrement remover and bagger 300 also includes a flexible elongate bag 360 having an open proximal end 362 and a closed distal end 364. The flexible elongate bag 360 is disposed over the hollow tube 304 of the waste collector 302 and the replaceable band cartridge 310. The replaceable band cartridge 310 is preloaded with a plurality of elastic bands 314.

Similar to the waste collector 110 described hereinabove, the waste collector 302 includes a retraction mechanism 370 having a cable 372 and a detachable clamp 374 located at a distal end 376 of the cable 372. A proximal end 378 of the cable 372 extends into the control head 306. The retraction mechanism 370 additionally includes a tensioner mechanism 380 located in the control head 306 having a spring-loaded cable winder 382 connected to the proximal end 378 of the cable 372. The trigger 320 also connected to the cable 372.

In use, the clamp 374 is attached to the closed distal end 364 of the flexible elongate bag 360 and the trigger 320 is actuated to draw the closed distal end 364 of the flexible elongate bag 360 up into the interior space 322 of the replaceable band cartridge 310 to form a pocket 390 for receipt of dog waste, such as, for example dog waste 200*c*. The excrement remover and bagger 300 is then advanced down over the portion of dog waste 200*c* such that the portion of dog waste 200*c* enters the pocket 390 (FIG. 12).

Once the portion of dog waste 200*c* has been positioned within the pocket 390, the excrement remover and bagger 300 is pressed further into the ground 210 to move the circumferential triggering plate 334 proximally relative to the band cartridge 310. As noted above, actuation of the triggering plate 334 forces an elastic band 314 off of the distal end 336 of the band cartridge 310. Once off the band cartridge 310, the elastic band 314 is free to move to the contracted state about the flexible elongate bag 360 to encase or seal the portion of dog waste 200*c* within a sealed "packet" 392 of the flexible elongate bag 360.

Thereafter, the trigger 320 is actuated to draw the cable 372 and thus the packet 392 up into the hollow tube 304 and form a subsequent pocket 390 for capture and removal of additional portions of dog waste 200*d*. Similar to that disclosed with the excrement remover and bagger 100 described hereinabove, the excrement remover and bagger 300 can be repeatedly actuated through the circumferential triggering plate 334 to sequentially push off additional elastic bands 314 and create subsequent packets 392 of dog waste. The now sealed flexible elongate bag 360 can be released from the clamp 374 for proper disposal.

In this manner the excrement remover and bagger 300 can be actuated by simply pressing the bagger 300 down over the excrement and actuating the triggering plate 334 to easily pick up and seal a portion of dog waste 200 within the flexible elongate bag.

Figure 14:
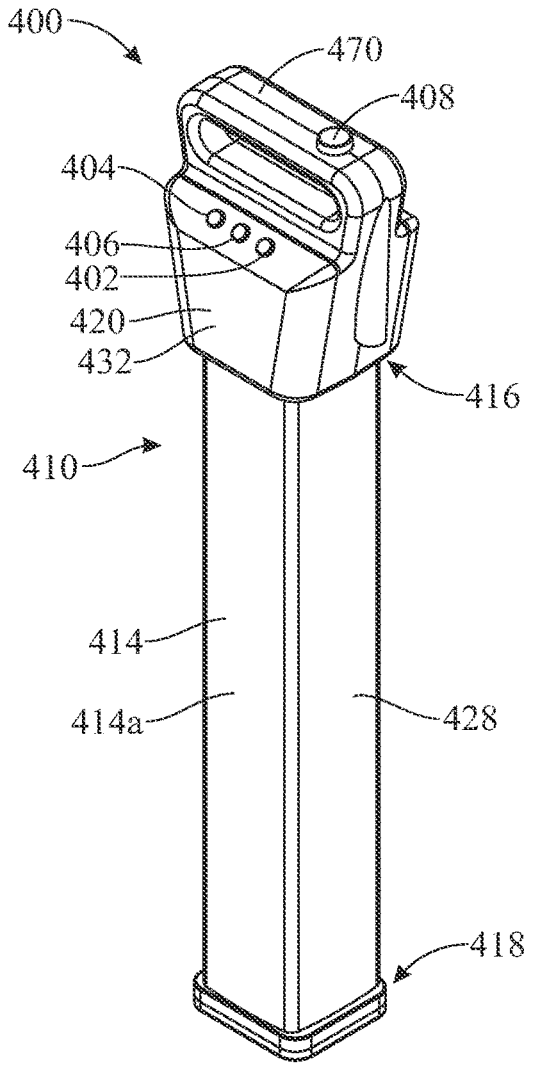
FIG. 14 presents a top isometric view of an excrement remover and bagger in accordance with a third illustrative embodiment of the present invention, a length-adjustable hollow elongate tube of the excrement remover and bagger shown retracted.
Figure 15:
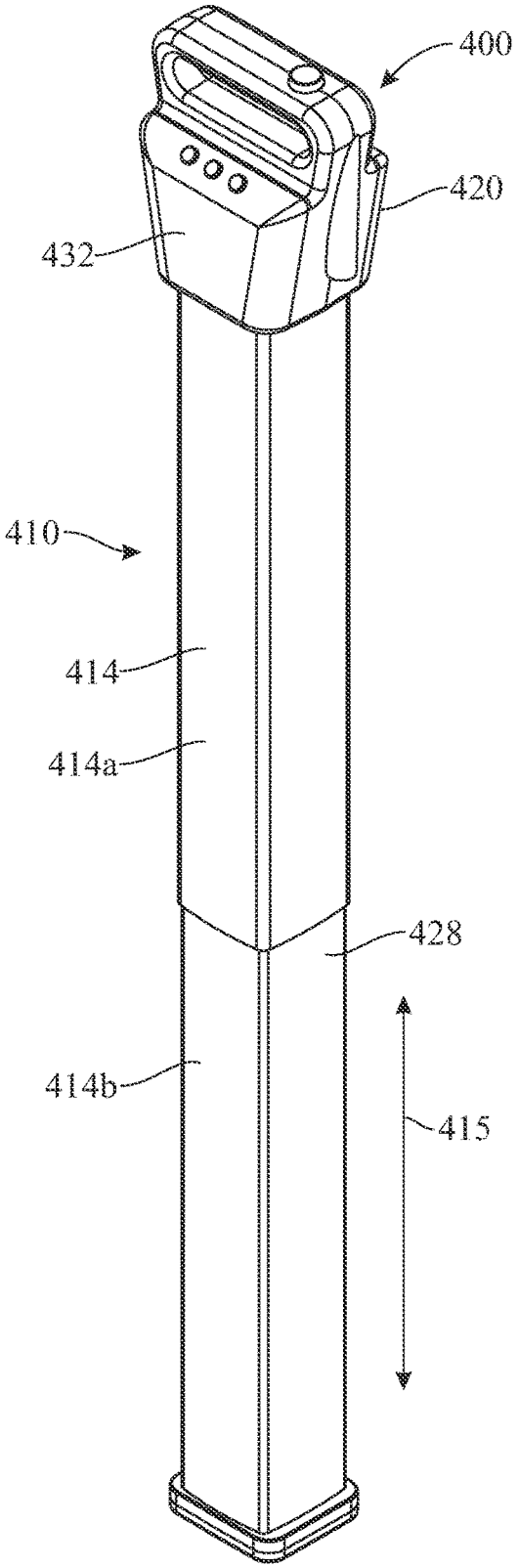
FIG. 15 presents a top isometric view of the excrement remover and bagger of FIG. 14, with the hollow elongate tube shown expanded to increase the total length of the excrement remover and bagger.

Referring to FIGS. 14-25, and initially with regard to FIGS. 14 and 15, an excrement remover and bagger 400 is illustrated in accordance with a third illustrative embodiment of the present invention, configured as an electrically-actuated doge waste collection system. As shown, the excrement remover and bagger 400 generally includes a waste collector 410 provided to be positioned over a portion of dog waste for removal. Similarly to previous embodiments, the waste collector 410 includes a rigid, elongate tube 414 having a rear or proximal end 416 and a front or open distal end 418. Unlike previous embodiments, however, the tube 414 of the present embodiment is length-adjustable; for instance and without limitation, the tube 414 may be telescopically-adjustable, by having two or more tube segments telescopically or axially displaceable relative to one another to vary the total length of the tube 414. For instance, the tube 414 of the present embodiment specifically includes two tube segments, a top tube segment 414*a* and a bottom tube segment 414*b*, wherein the bottom tube segment 414*b* is extendable from and retractable into the top tube segment 414*a*, as indicated by arrow 415 in FIG. 15. Length-adjustability of the tube 414 may allow a user to select the tube length to better adjust to their body height. Furthermore, should the tube 414 be used by different users (e.g., family members or roommates), each user may adjust the tube 414 to match their height prior to using the excrement remover and bagger 400. It must be noted that this length-adjustable feature may be used in previous embodiments shown herein; similarly, the present embodiment could instead be fitted with a fixed-length tube 414.

Figure 19:
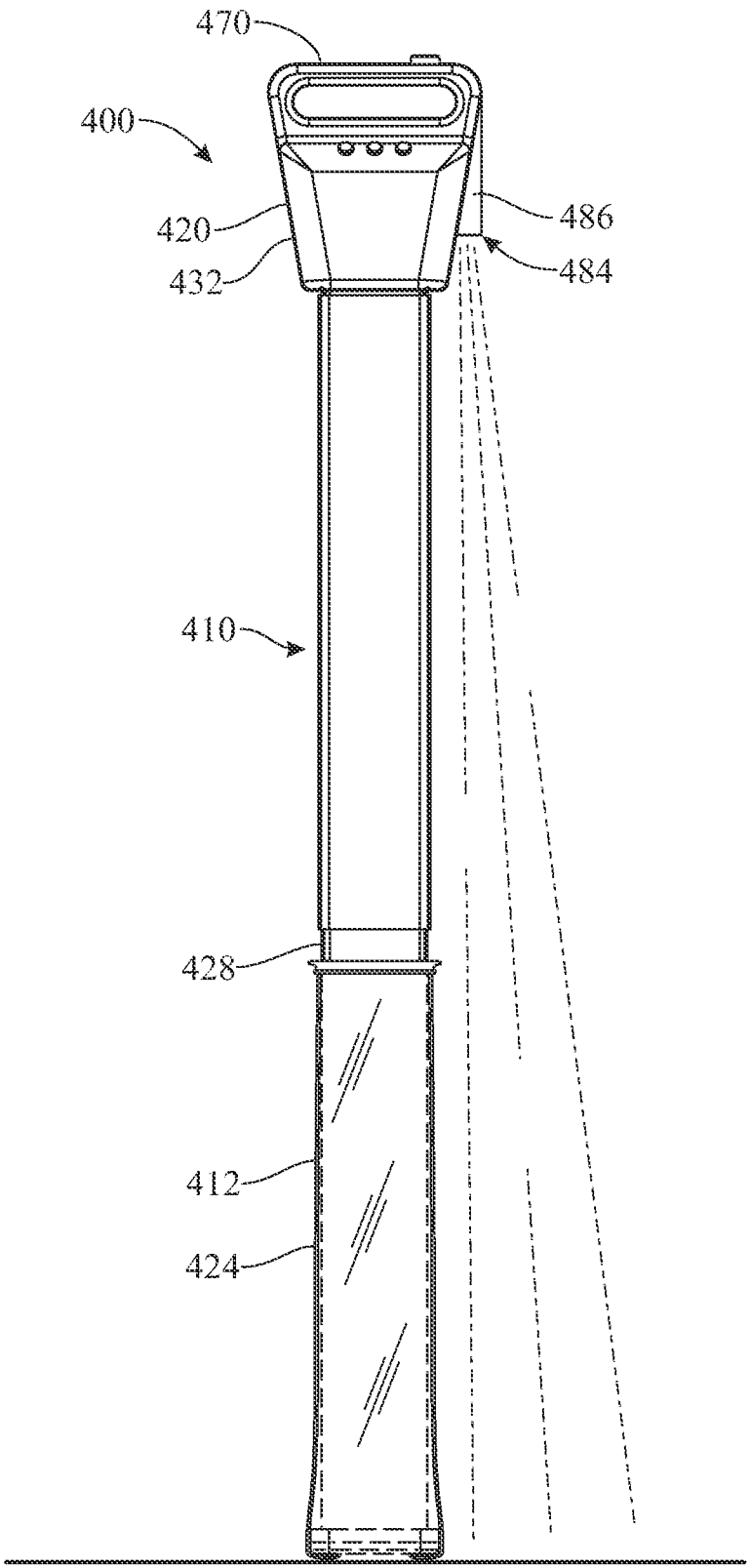
FIG. 19 presents a side elevation view of the excrement remover and bagger of FIG. 14, illustrating operation of a light emitter comprised in the excrement remover and bagger in order to illuminate an area adjacent the hollow elongate tube.
Figure 20:
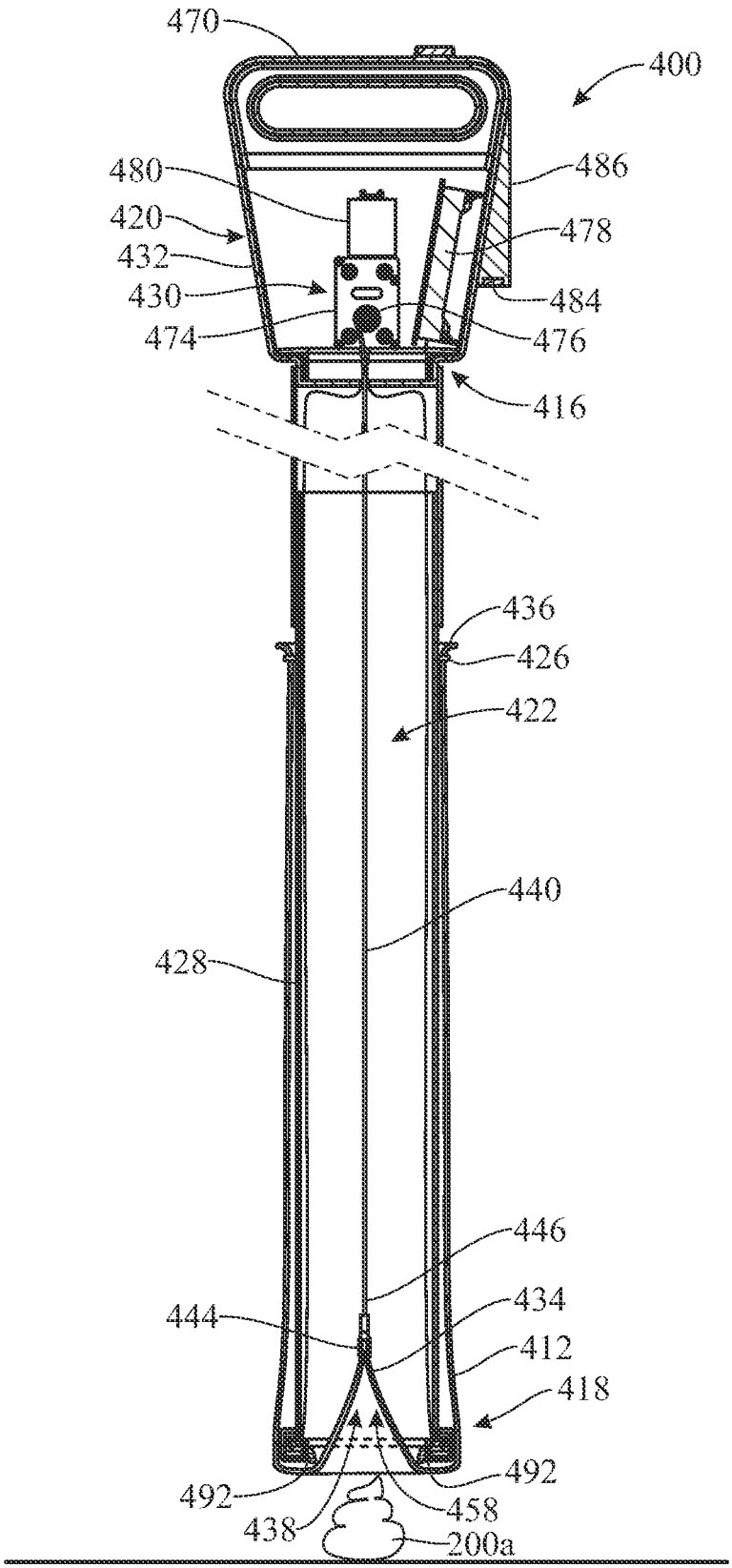
FIG. 20 presents a cross-sectional side elevation view of the excrement remover and bagger of FIG. 14 positioned over a piece of excrement to be removed and bagged.

Similarly to previous embodiments, a removable and disposable bag 412 (shown for instance in FIG. 19) formed as a flexible elongate sleeve 424 may be disposed about the waste collector 410, and more specifically, slidably positioned over an outer surface 428 of the tube 414 of the waste collector 410. The disposable bag 412 is provided to cover and store individual portions of dog waste and secure the portions in individual sections or packets of the disposable bag 412. This permits the excrement remover and bagger 400 to be used multiple times during a person's daily walks with their dog to pick up the waste portions as they are deposited on the ground by the dog. As shown in FIG. 20, the flexible elongate sleeve 424 has a first or closed distal end 434 and a second or open proximal end 436 and defines an interior space 438, when inverted, to capture and secure dog waste.

The flexible elongate sleeve 424 of the bag 412 is made of a material capable of being welded to form the aforementioned individual sections or packets as will be described in more detail hereinafter. For instance, the flexible elongate sleeve 424 may be made of, or comprise, polyethylene or other thermoplastic material capable of heat welding such that parts of the flexible elongate sleeve 424 can weld onto each other for purposes that will be described hereinafter.

As shown in FIG. 1 and, in more detail, in FIG. 20, a control head 420 is mounted on the proximal end 416 of the tube 414. The control head 420 includes a control head housing 432 mounted to the rear or proximal end 416 of the tube 414. A handle 470 can be attached to, or integrally formed with, the control head housing 432 and configured to allow a user to hold the excrement remover and bagger 400 with the tube 414 oriented downward and the distal end 418 of the tube 414 close to the ground (FIG. 20). For instance, in the present embodiment, the handle 470 is arranged at a top of the control head housing 432 and extends transversally therealong.

Figure 25:
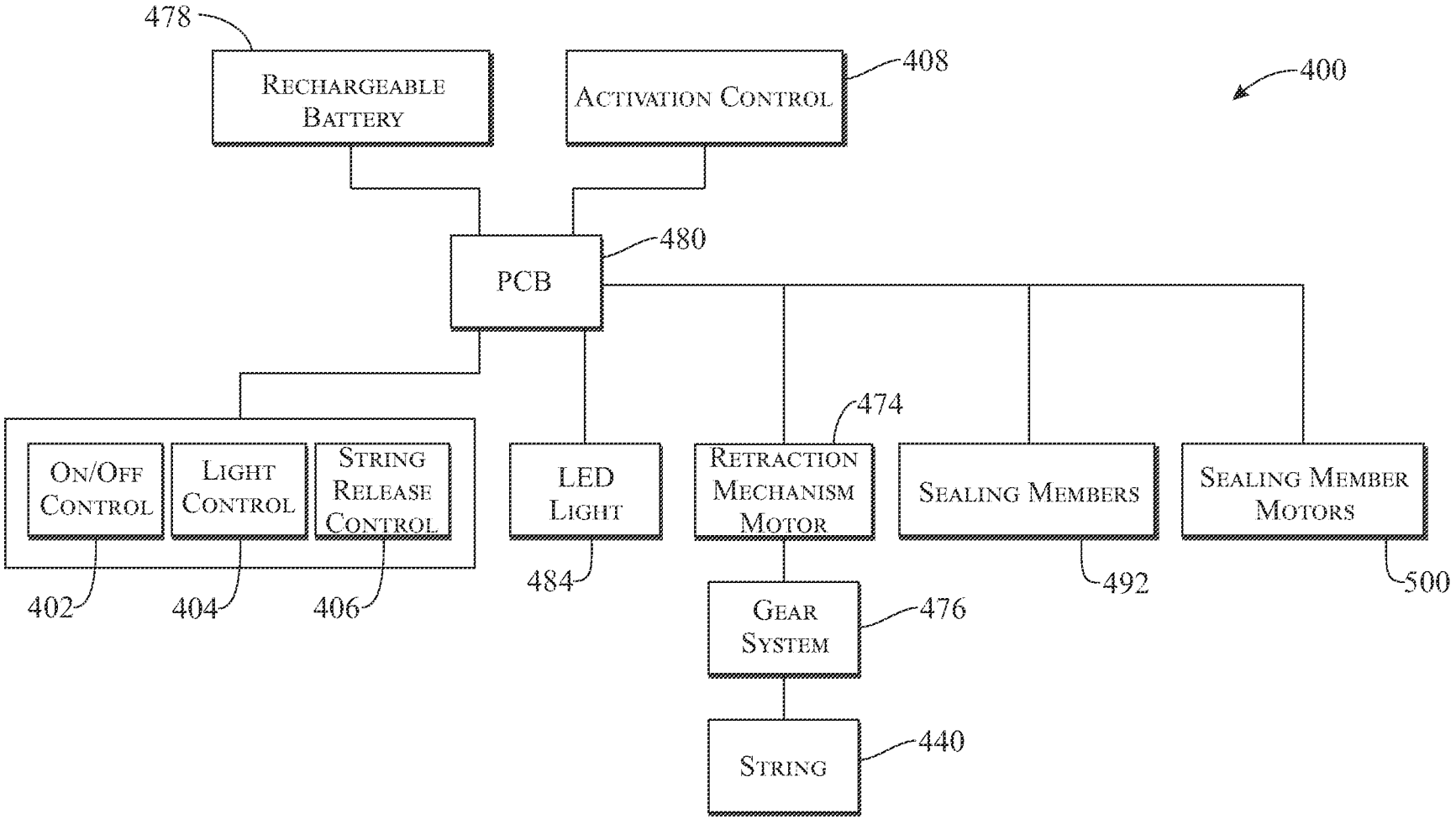
FIG. 25 presents a block diagram of electrical and functional components comprised in the excrement remover and bagger of FIG. 14.

Similarly to previous embodiments, the excrement remover and bagger 400 includes a retraction mechanism 430 which is operable to draw the disposable bag 412 into an interior space 422 of the tube 414 as portions of dog waste are collected. The retraction mechanism 430, details of which are shown in FIGS. 14, 20 and 25, includes a flexible elongate element 440 (e.g., wire, cable, string, etc.), a releasable clamp 444, a retraction mechanism motor 474, and a gear system 476. The retraction mechanism motor 474 and gear system 476 are housed in the control head 420, are powered by one or more rechargeable batteries 478 (also located within the control head 420), and are configured to pull on the flexible elongate element 440 to pull the bag 412 upward and into the interior space 422 of the tube 414. The retraction mechanism 430 further includes the aforementioned releasable clamp 444, at a distal end 446 of the flexible elongate element 440, for removably engaging the distal end 434 of the flexible elongate sleeve 424 to the flexible elongate element 440.

As shown in FIG. 25, the excrement remover and bagger 400 further includes a control unit, which may include one or more processors, microprocessors, controllers, or the like, which may be carried, for instance and without limitation by a PCB (printed circuit board), The control unit is hereinafter referred to generically as PCB 480. Furthermore, the excrement remover and bagger 400 may include a set of one or more user-operable controls configured to allow a user to operate the excrement remover and bagger 400. For instance and without limitation, the user-operable controls may include an ON/OFF control 402, a light control 404, a string release control 406, and activation control 408. The controls may be in the form of buttons (as shown), tactile controls on one or more screens provided for instance in the control head housing 432, mechanical switches, voice-activated controls, or combinations thereof. By way of example, the controls 402, 404, 406, 408 shown herein are in the form of depressible buttons. With continued reference to FIG. 25, the excrement remover and bagger 400 further includes one or more lights 484 (e.g., one or more LEDs) configured to emit light responsively to user operation of the light control 404. As shown in FIGS. 19 and 20, the one or more lights 484 may be arranged on a protruding section 486 of the control head housing 432 and oriented downward such that light emitted by the one or more lights 484 illuminates a side of the waste collector 410 and the area of the ground adjacent to the side of the waste collector 410, allowing the user to more easily place the distal end 418 of the tube 414 on a piece of excrement. The one or more batteries 478 provide electrical power to the electrical components comprised in the excrement remover and bagger 400 and described heretofore.

Figure 16:
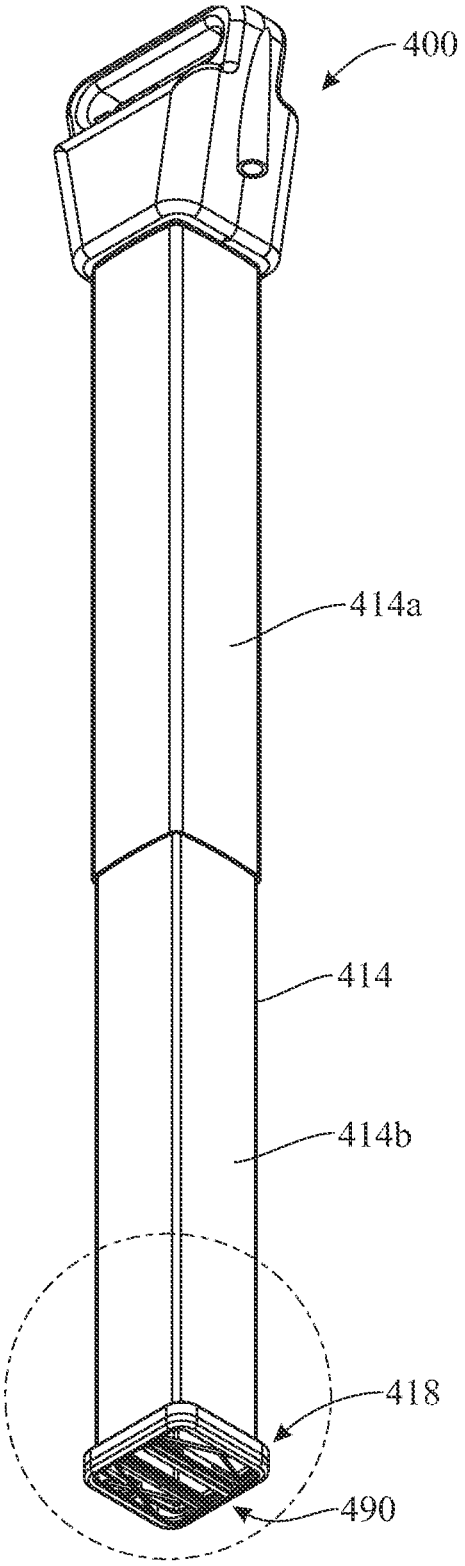
FIG. 16 presents a bottom isometric view of the excrement remover and bagger of FIG. 15.
Figure 17:
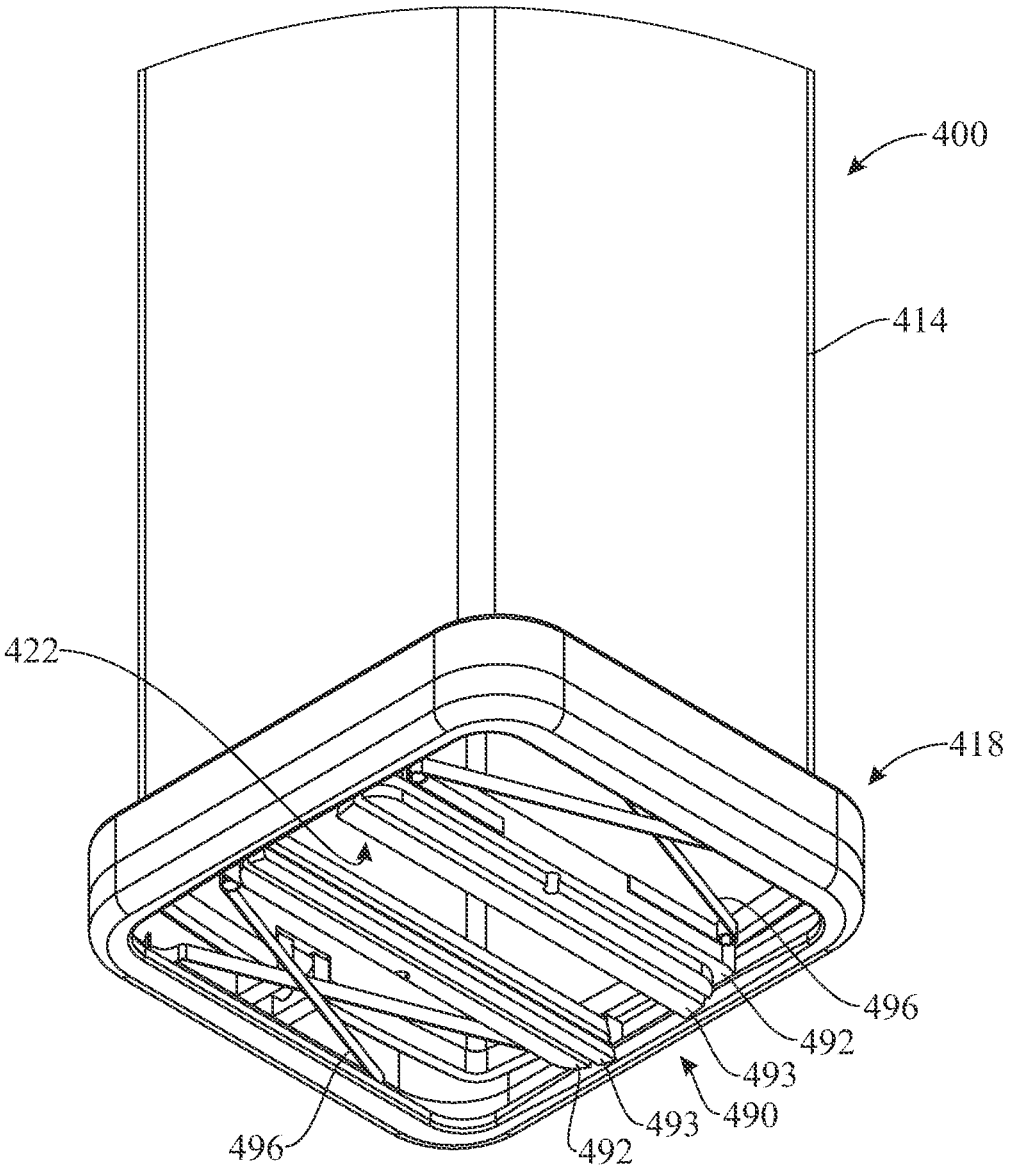
FIG. 17 presents an enlarged, bottom isometric view of the excrement remover and bagger of FIG. 15, showing details of the distal end of the hollow elongate tube.
Figure 18:
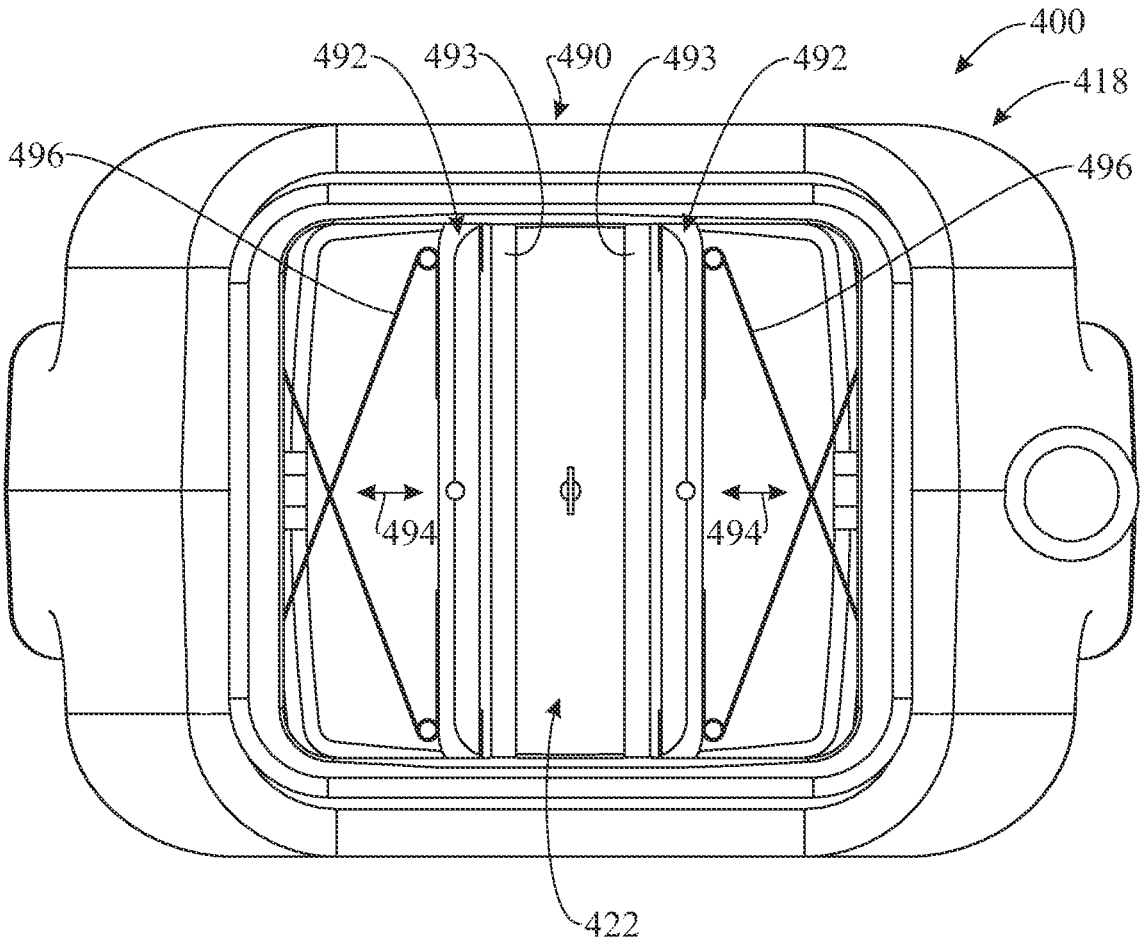
FIG. 18 presents a bottom plan view of the excrement remover and bagger, with sealing members shown in a partially open position.

Unlike previous embodiments, in which the dog excrement remover and bagger included a bag sealing mechanism based on elastic bands, the excrement remover and bagger 400 of the present embodiment comprises a bag sealing mechanism 490 configured to apply heat and pressure to the flexible elongate sleeve 424 of the bag 412 at discrete lengths or positions therealong and thereby heat weld and seal the elongate sleeve 424 at said discrete lengths or positions. As shown in FIG. 16 and better shown in the enlarged views of FIGS. 17 and 18, the bag sealing mechanism 490 includes two sealing members 492. Each sealing member 492 may include a heating element 493 transversely movable about the open distal end 418 of the tube 414 such that the heating elements 493 are movable towards and away from one another, as indicated in FIG. 18 by arrows 494. In some embodiments, the heating elements 493 may be straight or formed as strips, as shown for instance in the present embodiment. Each sealing member 492, and thus each heating element 493, is translationally carried by an extendable and retractable structure 496; for instance, the extendable and retractable structure 496 may include a scissor mechanism attached to the tube 414 and movably carrying the heating element 493, as shown in the drawings. The heating elements 493 are in electrical communication with the electrical components housed in the control head housing 432 and may be provided with electrical power via wires or cables 498 (FIG. 21) responsively to user operation of the activation control 408. The heating elements 493 may be resistive, and are configured to warm up in the event of electrical power being provided to the heating elements 493 responsively to user operation of the activation control 408. Warming of the heating elements 493 may transfer sufficient heat to the flexible elongate sleeve 424 to cause a heat welding of the flexible elongate sleeve 424 of the bag 412 as will be described in detail hereinafter.

Figure 21:
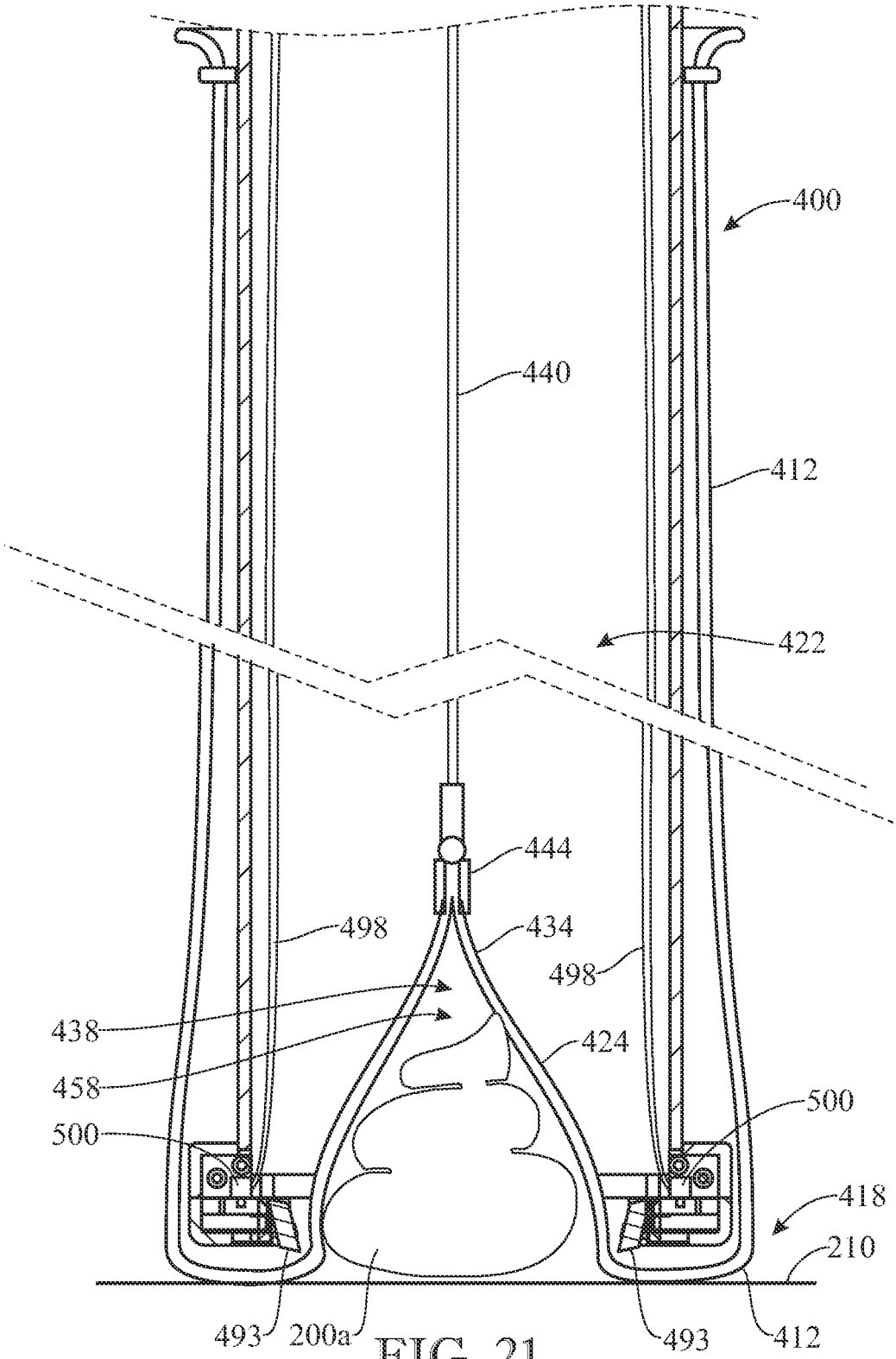
FIG. 21 presents an enlarged, cross-sectional side elevation view of a distal end of the excrement remover and bagger of FIG. 14, showing the sealing members spaced apart from one another.

As further shown in FIGS. 21 and 25, the excrement remover and bagger 400 further includes a sealing member motor 500 configured to move (i.e. extend and retract) the extendable and retractable structure 496 (e.g., scissor mechanism) which carries the sealing member 492. The sealing member motors 500 can be in electrical communication with the electrical components housed in the control head housing 432 and may be provided with electrical power via the aforementioned wires or cables 498 (FIG. 21) also responsively to user operation of the activation control 408.

With reference now to FIGS. 14 and 20-24, use of the excrement remover and bagger 400 to collect and temporarily store one or more dog waste deposits 200*a* will now be described. Initially with regard to FIG. 20, the excrement remover and bagger 400 is prepared for use by positioning the disposable bag 412 onto the waste collector 410 by sliding the disposable bag 412 over the tube 414 of the waste collector 410 and slightly tightening the proximal end 436 of the bag 412 against the outer surface 428 of the tube 414 by means of one or more elastic bands 426, such that the bag 412 does not fall due to gravity but is yet allowed to be pulled downward. In some embodiments, the elastic band(s) 426 may be embedded in the bag 412. The closed distal end 434 of the flexible elongate sleeve 424 of the bag 412 is positioned over the open distal end 418 of the tube 414, and the releasable clamp 444 of the retraction mechanism 430 is affixed to the closed distal end 434 of the flexible elastic sleeve 424. In the situation of FIG. 20, the sealing members 492 are arranged transversely spaced apart from one another.

Next, the user may power the excrement remover and bagger 400 on by operating the ON/OFF control 402 (FIG. 1). Powering the unit allows the battery or batteries 478 to power the PCB 480 such that user operation of the remaining controls may cause the unit to operate responsively. Once the unit is powered on, the retraction mechanism 430 may draw the distal end 434 of the flexible elongated sleeve 424 of the bag 412 into the interior space 422 of the tube 414. As the flexible elastic sleeve 424 is drawn into the tube 414, the flexible elastic sleeve 424 is inverted to form the interior space 438 described hereinabove. This inversion of the flexible elastic sleeve 424 forms a "pocket" 458 in the interior space 438 of the disposable bag 412, adjacent the distal end 418 of the tube 414 for receipt of an initial dog waste deposit 200*a*.

Once the pocket 458 is formed, the user may position the excrement remover and bagger 400 over a dog waste deposit 200*a* and advance the unit down over the dog waste deposit 200*a* such that the dog waste deposit 200*a* is covered by the distal end 418 of the tube and received within the pocket 458 formed in the interior space 438 of the flexible elastic sleeve 424.

Next, as shown in FIG. 21, the user may advance the excrement remover and bagger 400 down over the dog waste deposit 200*a* until the distal end 418 of the tube 414, which is covered by the bag 412, engages the ground 210 or other surface upon which the dog waste deposit 200*a* is deposited. Once the dog waste deposit 200*a* has been completely covered and the distal end 418 pressed onto the ground 210, the user operates the activation control 408 (FIG. 1) on the handle 470.

Figure 22:
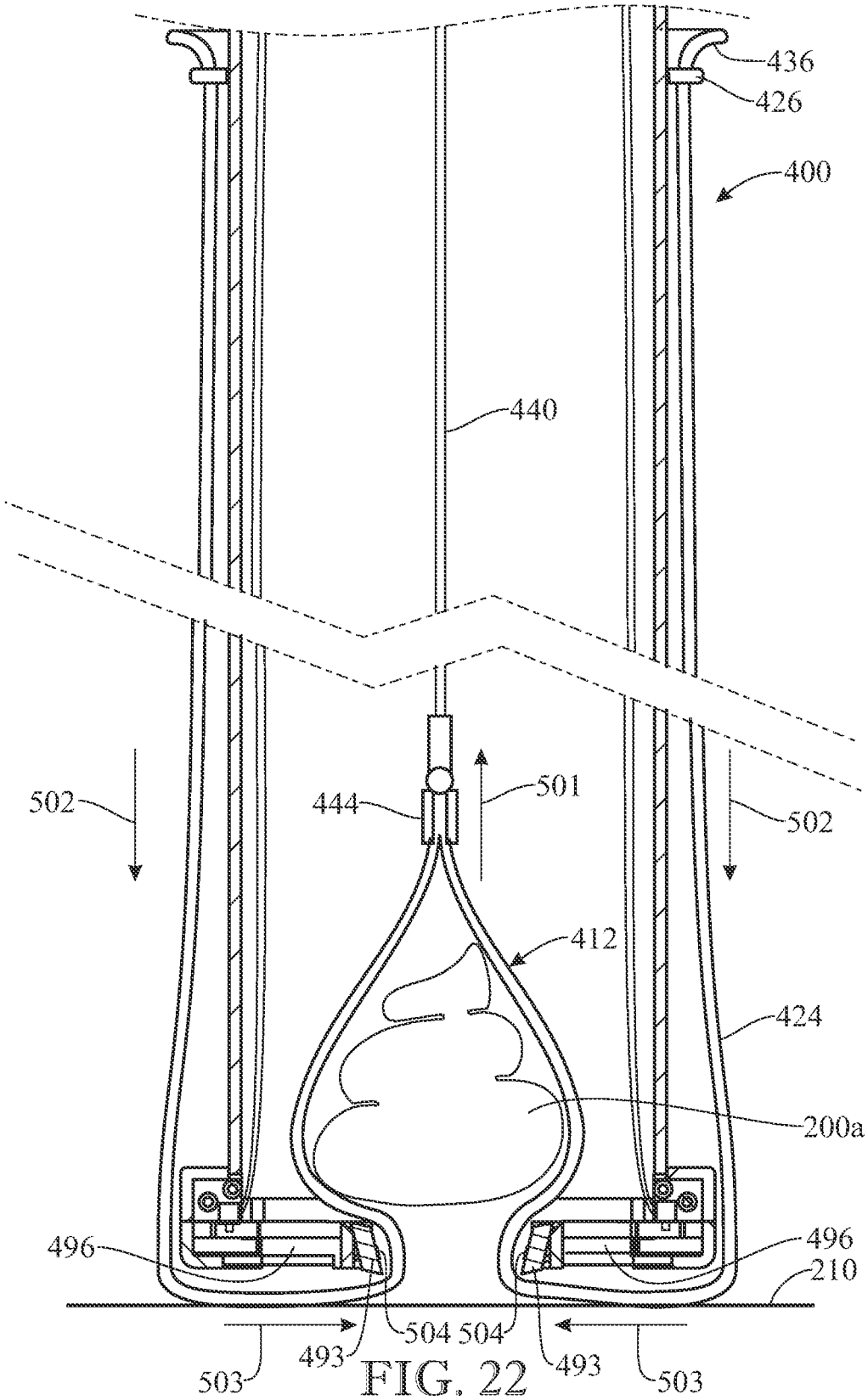
FIG. 22 presents an enlarged, cross-sectional side elevation view of the distal end of the excrement remover and bagger of FIG. 14, showing the sealing members being moved towards one another and the piece of excrement being scooped up into the excrement remover and bagger.

As shown in FIG. 22, responsively to user operation of the activation control 408, the PCB 480 activates the retraction mechanism motor 474 and sealing member motors 500. More specifically, the PCB 480 activates the retraction mechanism motor 474 to initially retract the flexible elongate element 440 and draw the flexible elongate sleeve 424 upwardly within the interior 422 of the tube 414, as indicated by arrow 501. As the flexible elongate sleeve 424 is drawn upwardly through the interior space 422, the flexible elongate sleeve 424 is simultaneously drawn downwardly along the outer surface 428 of the tube 414 (while still slightly tightened radially by the elastic band 426) toward the distal end 418 of the tube 414, as indicated by arrows 502. As the retraction mechanism motor 474 is operated to cause the flexible elongate element 440 to pull the bag 412 upward within the tube 414, the PCB 480 activates the sealing member motors 500 to expand the extendable and retractable structures 496 (e.g., scissor mechanism) as indicated by arrows 503. Expansion of the extendable and retractable structures 496 causes the sealing members 492 to move transversely inward and toward one another. As the sealing members 492 move towards one another, they "scoop" the dog waste deposit 200*a* upward; said upward "scooping" effect is enhanced by the fact that the sealing members 492, and more specifically, the heating elements 493 of the sealing members 492, end in a respective rearward-sloped surface 504 which pushes the dog waste deposit 200*a* upward therealong as the surfaces 504 advance onto the dog waste deposit 200*a*.

Figure 23:
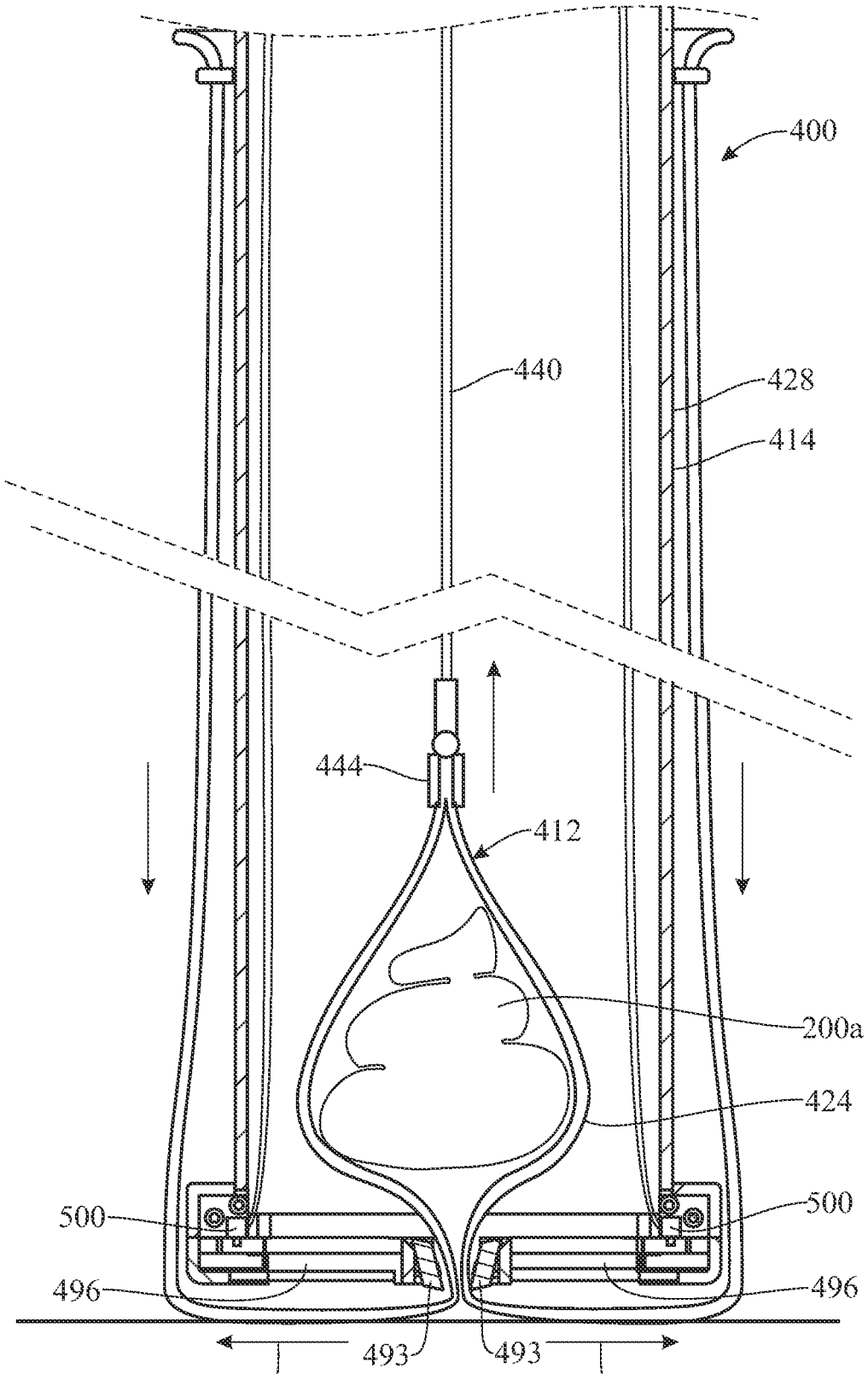
FIG. 23 presents an enlarged, cross-sectional side elevation view of the distal end of the excrement remover and bagger of FIG. 14, showing the sealing members closed against one another and the heating elements welding opposite sides of the bag to each other to sealingly enclose the piece of excrement inside a pocket formed in the bag.

Eventually, as shown in FIG. 23, the extendable and retractable structures 496 bring the heating elements 493 sufficiently close to one another to cause opposite sides of the flexible elongated sleeve 424 of the bag 412 to contact and preferably press against one another. The PCB 480 then deactivates the sealing member motors 500 and provides electrical current to the heating elements 493 via the cables 498, causing the heating elements 493 to warm up and sufficiently melt the bag 412 to cause said opposite sides of the flexible elongated sleeve 424 to weld against one another. Welding of the opposite sides of the flexible elongated sleeve 424 forms a sealed closure 506 (FIG. 24).

Figure 24:
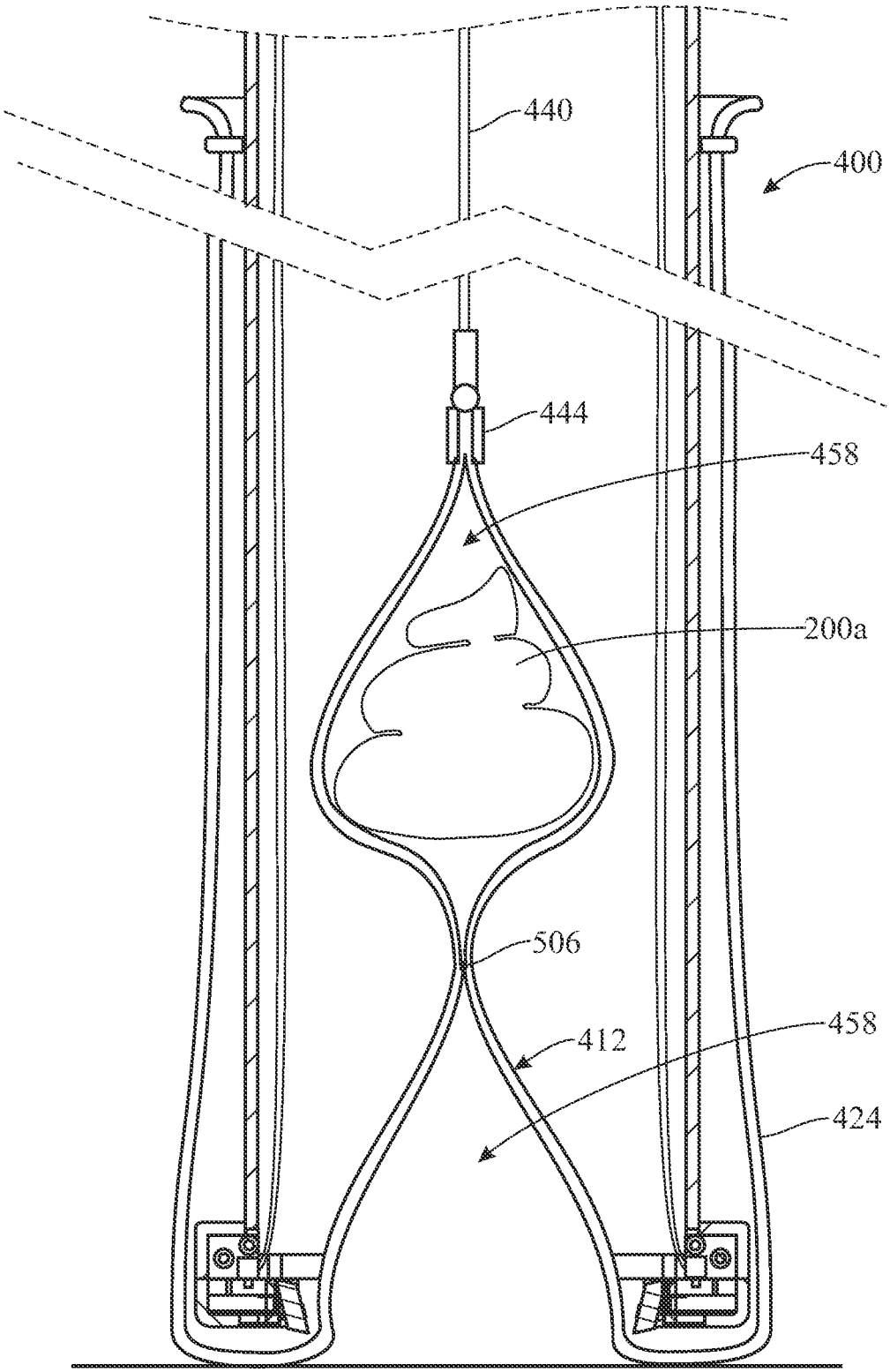
FIG. 24 presents an enlarged, cross-sectional side elevation view of the distal end of the excrement remover and bagger of FIG. 14, where the pocket of FIG. 23 has been pulled upward and a new open pocket is formed at the distal end of the excrement remover and bagger to receive a subsequent piece of excrement.

Next, as shown in FIGS. 23 and 24, the PCB 480 actuates the sealing member motors 500 in reverse mode so that the extendable and retractable structures 496 retract and pull the sealing members 492 away from one another, as indicated by arrows 508. The PCB 480 also actuates the retraction mechanism motor 474 to pull the flexible elongate element 400 upward, thereby pulling the bag 412 upward. In consequence, as shown in FIG. 24, the sealed, top pocket 458 and dog waste deposit 200*a* contained therein are lifted, while a second pocket 458 is formed between the sealed closure 506 and the bottom end of the bag 412 at the distal end 418 of the tube 414. The excrement remover and bagger 400 is thus ready for a subsequent use, to pick up another dog waste deposit.

The process may be repeated with additional dog waste deposits, etc. to form additional dog waste packets along the bag 412 as the bag 412 is pulled into the tube 414 of the waste collector 410. Once the walk has been completed, and the disposable bag 412 filled up or the operator simply wishes to dispose of the collected waste in the accumulated packets, the user operates the string release control 406 (FIG. 14). Operation of the string release control 406 causes the clamp 444 to release from the disposable bag 412, allowing the bag 412 (with safely and hygienically sealed pockets) to slide out of the tube 414 through the distal end 418 thereof and be able to be disposed properly.

Thus, in this manner, the disclosed excrement remover and bagger 400 provides a convenient and sanitary way of removing and collecting dog waste for subsequent disposal.

Referring now to FIGS. 26-36, an excrement remover and bagger 600 is depicted in accordance with a fourth illustrative embodiment of the present invention, configured as an electrically-actuated doge waste collection system. The excrement remover and bagger 600 of the present embodiment is constructed similarly to the excrement remover and bagger 400 of FIGS. 14-25, with the exception of bag-welding and pocket-forming features at the distal end of the tube, which will be described in detail hereinafter.

Figure 26:
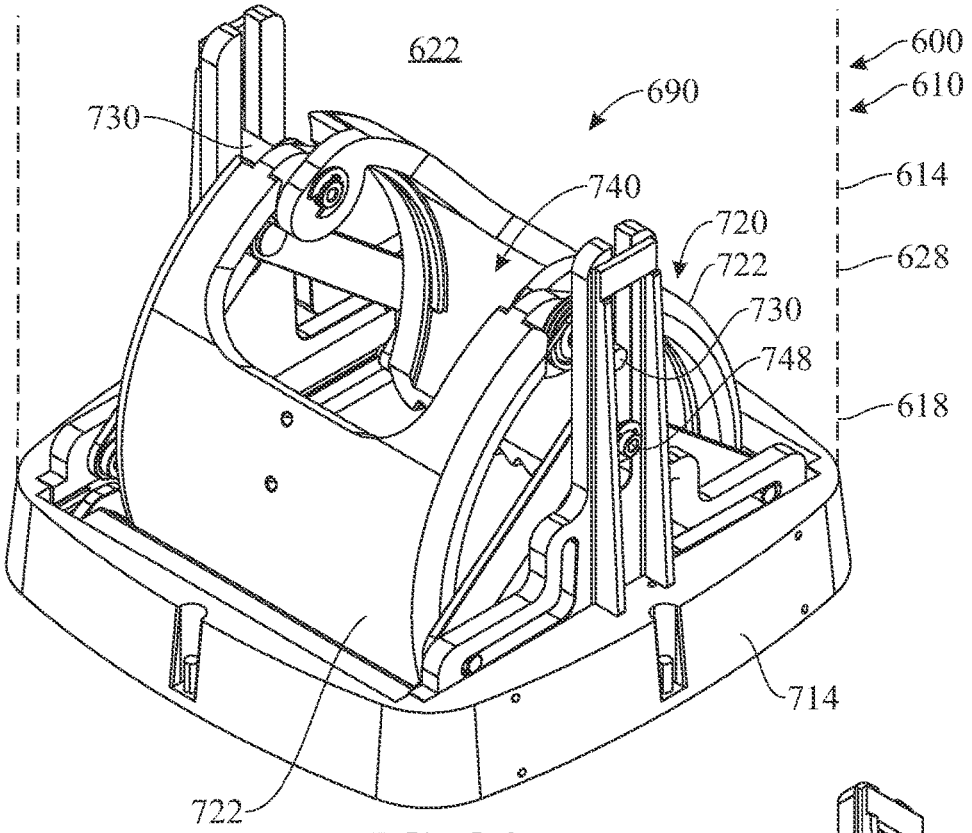
FIG. 26 presents a top, side isometric view of a distal end of an excrement remover and bagger in accordance with a further embodiment of the invention, where the lifting mechanism and bag sealing mechanism are shown in an open position and non-sealing position, respectively.
Figure 27:
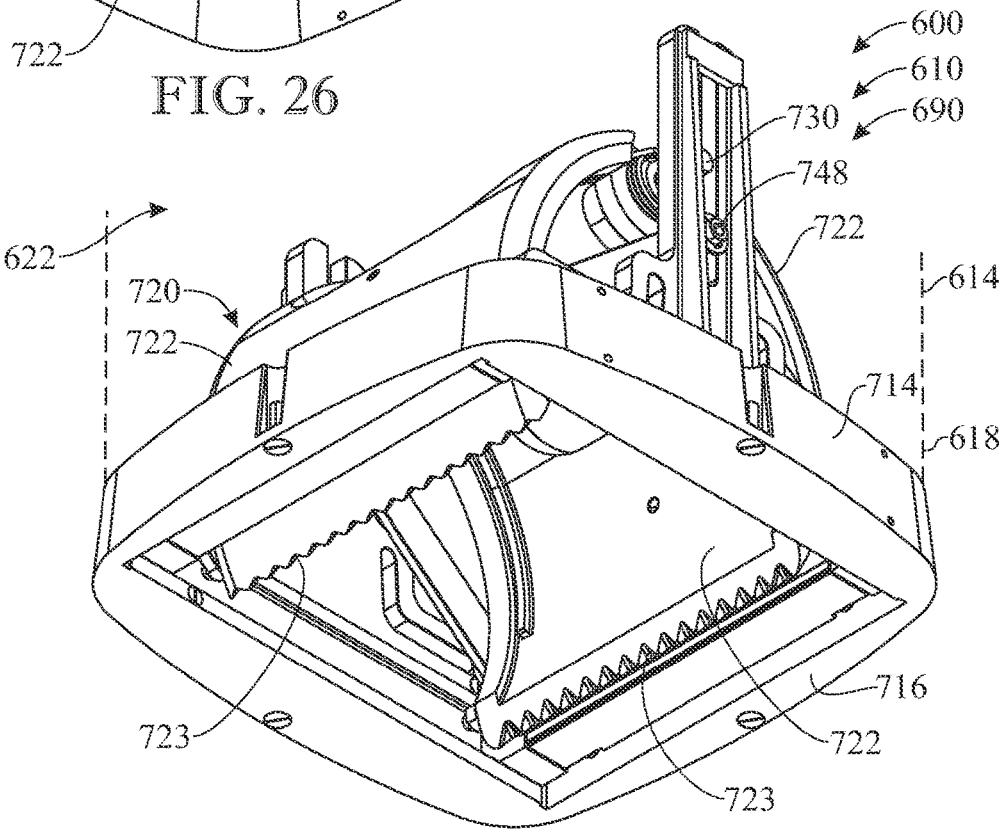
FIG. 27 presents a bottom, side isometric view of the distal end of the excrement remover and bagger of FIG. 26.

With reference initially to FIGS. 26 and 27, the excrement remover and bagger 600 generally includes a waste collector 610 provided to be positioned over a portion of dog waste for removal. Similarly to previous embodiments, the waste collector 610 includes a rigid, elongate tube 614, a front or open distal end 618 of which is shown schematically in phantom lines. As with other embodiments, the tube 614 of the present embodiment may be length-adjustable or have a fixed length.

Similarly to previous embodiments, a removable and disposable bag 612 (shown for instance in FIG. 33) formed as a flexible elongate sleeve 624 made of a heat-welding material and slidably positioned over an outer surface 628 of the tube 614 of the waste collector 610. The flexible elongate sleeve 624 has a first or closed distal end 634, shown for instance in FIG. 33, and a second or open proximal end (not shown), and defines an interior space 638 for capturing and securing dog waste.

Though not specifically shown in FIGS. 26-36, the excrement remover and bagger 600 of the present embodiment may include a control head at the proximal end of the tube 614 for operating the excrement remover and bagger 600, similarly, for instance, to the control head 420 of the previous embodiment. The control head may operate a retraction mechanism 630. As shown for instance in FIG. 33, the retraction mechanism 630 may include a flexible elongate element 640 (e.g., wire, cable, string, etc.), a releasable clamp 644 at a distal end 646 of the flexible elongate element 640, and a battery-powered retraction mechanism motor and gear system (not shown, but which may be similar to the retraction mechanism motor 474 and gear system 476 of the previous embodiment). The retraction mechanism 630 is configured to pull on the flexible elongate element 640 to draw the disposable bag 612 into an interior space 622 of the tube 614 as portions of dog waste are collected. The excrement remover and bagger 600 may further include a control unit, and one or more user-operable controls configured to operate the retraction mechanism 630, and one or more visual indicators and/or light emitters, which may be arranged on the control head and may be similar for instance to the ON/OFF control 402, a light control 404, a string release control 406, activation control 408, and lights 484 of the previous embodiment.

Similarly to the previous embodiment, the excrement remover and bagger 600 of the present embodiment includes a bag sealing mechanism 690 configured to apply heat and pressure to the flexible elongate sleeve 624 of the bag 612 at discrete lengths or positions therealong and thereby beat weld and seal the elongate sleeve 624 at said discrete lengths or positions, forming discrete, consecutive pockets configured to store a series of waste deposits scooped along time. As shown for instance in FIGS. 31 and 33, the bag sealing mechanism 690 includes two sealing members 692. Each sealing member 692 includes a respective heating element 693 movable about the open distal end 618 of the tube 614. Similarly to the previous embodiment, the heating elements 693 may be in electrical communication with the electrical components housed in the control head and may be provided with electrical power via wires or cables (similarly to the cables 498 described heretofore with reference to FIG. 21) responsively to user operation of the activation control. The heating elements 693 may be resistive, and may be configured to warm up in the event of electrical power being provided to the heating elements 693 responsively to user operation of the activation control. Warming of the heating elements 693 may transfer sufficient heat to the flexible elongate sleeve 624 to cause a heat welding of the flexible elongate sleeve 624 of the bag 612 as will be described in detail hereinafter.

Also similarly to the previous embodiment, the heating elements 693 are transversely movable, i.e. movable perpendicularly to a longitudinal direction of the tube 614, and are movable towards one another, as shown in the sequence of FIGS. 33-36, and away from one another, allowing for repetitive use of the sealing elements 693 to form discrete and consecutive waste deposit packages. In the present embodiment, each heating element 693 is elongated and comprises a respective, generally flat, elongated and continuous inwardly-facing heating surface 700 formed as a strip, such that the heating surfaces 700 may be brought to a relatively close, sealing position in which they sandwich the flexible elongate sleeve 624 of the disposable bag 614 and create a welded line or sealed closure 702 (FIG. 36) along the flexible elongate sleeve 624. Each sealing member 692, and thus each heating element 693, is translationally carried by a carriage 704, which may be formed, for instance and without limitation, as an elongate piece or crossbar 706 provided with a pair of rollers 708 and 710 to facilitate transverse movement of the carriage 704.

Figure 28:
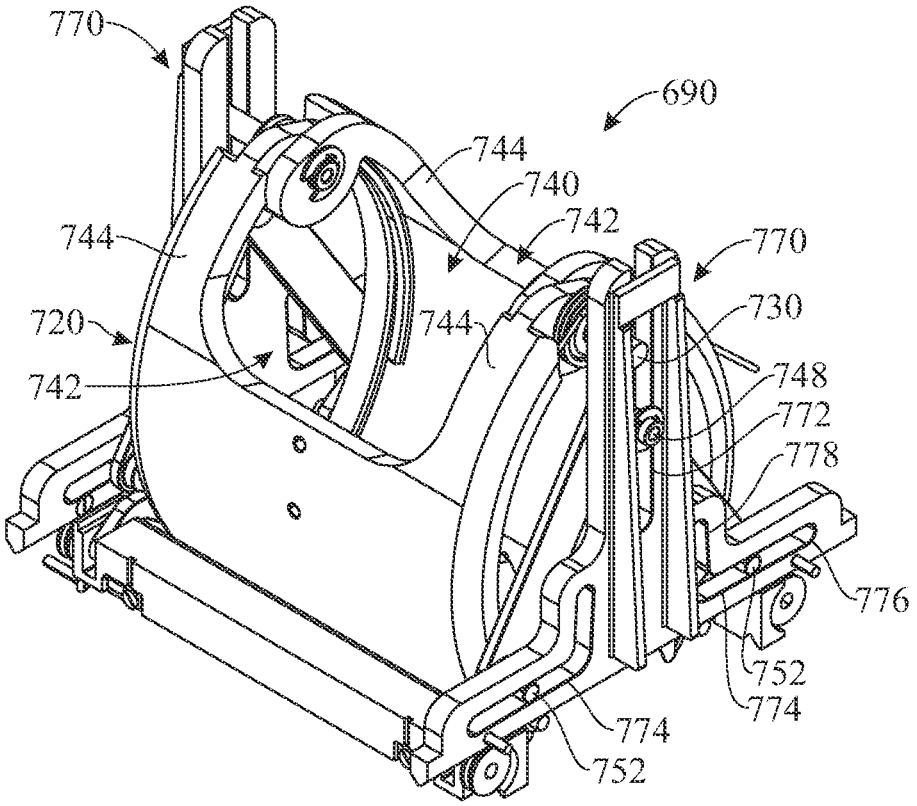
FIG. 28 presents a top, side isometric view similar to FIG. 26, where the outer skirt has been omitted.
Figure 29:
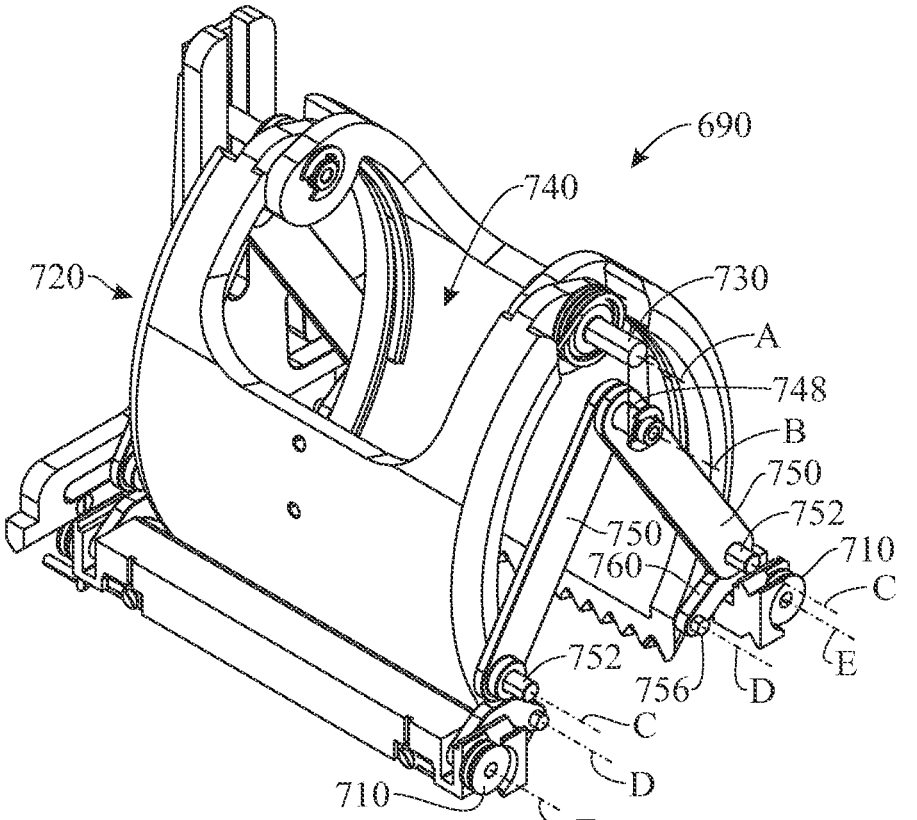
FIG. 29 presents a top, side isometric view similar to FIG. 28, where one of the guides has been omitted.
Figure 36:
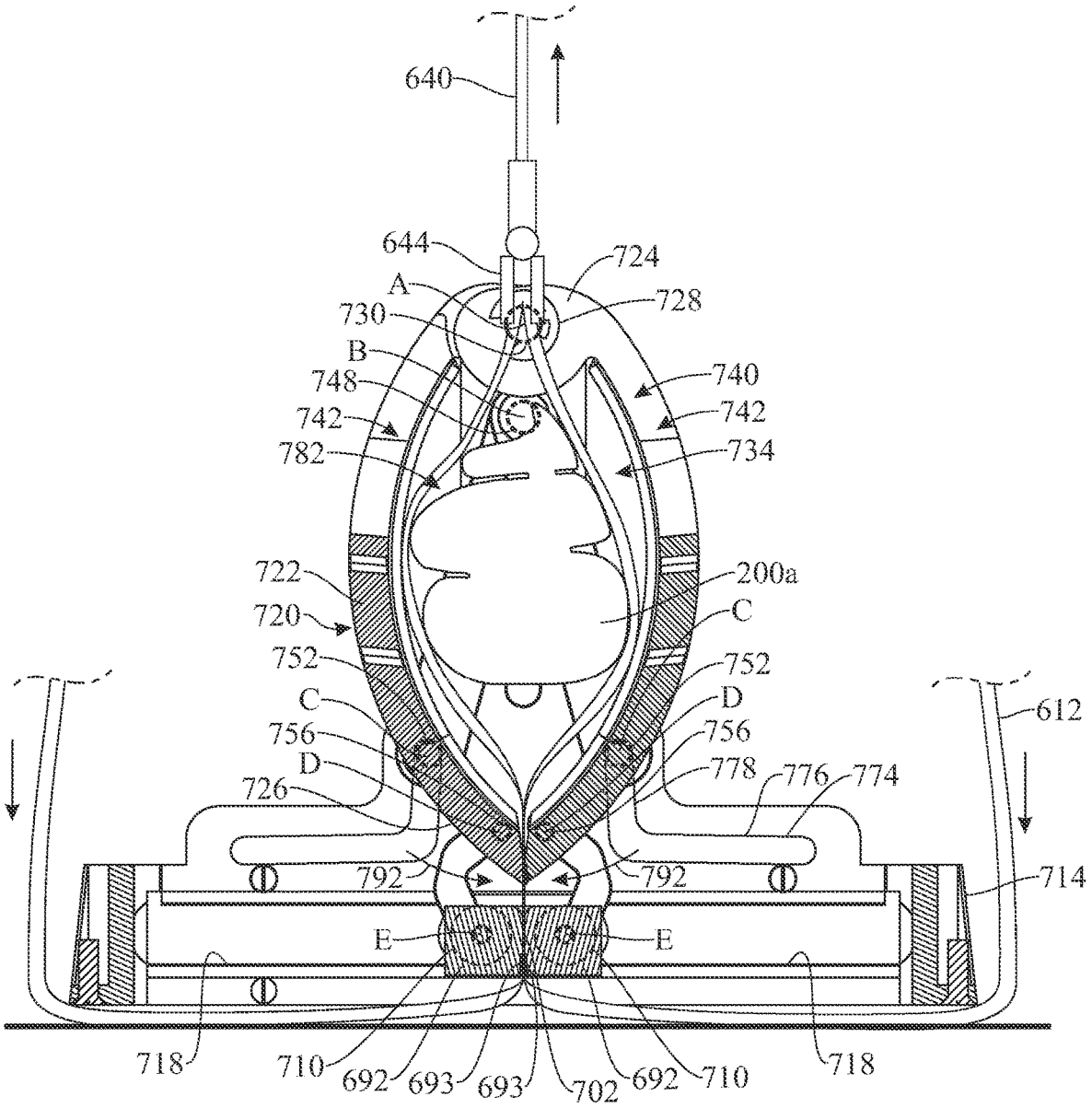
FIG. 36 presents a cross-sectional, side elevation view, similar to the previous figure, where the lifting mechanism has reached the closed position and has been vertically moved to an elevated position, and the sealing mechanism has been moved to the sealing position.

With continued reference to FIGS. 31 and 33, the bag sealing mechanism 690 of the present embodiment further includes lifting mechanism 720 comprising a pair of lifting blades, buckets or jaws, hereinafter referred to generically as jaws 722. The jaws 722 include a top or first end 724 and a bottom or second end 726. The top or first ends 724 of the jaws 722 may be pivotably connected to one another by a hinged connection 728, and about a jaw pivoting or rotation axis A. At opposite ends of the top or first ends 724 of the jaws 722, a respective top pin 730 may protrude outward of the hinged connection 728 in a same longitudinal direction as the jaw rotation axis A defined by the hinged connection 728. The jaws 722 are reversibly pivotable between an open position and a closed position, shown for instance in FIGS. 33 and 36, respectively. In the open position, as will be described in greater detail hereinafter, the jaws 722 may be placed over a dog waste in order to pick up the dog waste; to enhance the scooping action, such as when the dog waste has been deposited on grass, the bottom or second ends 726 of the jaws 722 may include an undulated or toothed contour 723. When the lifting mechanism 720 is operated to switch to the closed position, as best shown in FIG. 36, the bottom or second ends of the jaws 722 close against one another. Furthermore, the jaws 722 are configured (shaped and sized) to define an internal space 734 therebetween when pivoted to the closed position; for instance, in the present embodiment, the jaws 722 form a "clamshell" arrangement (however, alternative embodiments are contemplated without departing from the scope of the present disclosure). The internal space 734 receives the dog waste pocket 782 formed by the closed jaws 722. As best shown in FIGS. 26, 28 and 29, the jaws 722 may jointly define a top opening 740 configured to allow the dog waste pocket 782 to be pulled out of the internal space 734 by the retraction mechanism 630 once the dog waste pocket 782 has been heat-sealed, as will be described in greater detail hereinafter. In some embodiments, such as the present embodiment, and with reference to FIG. 28, the jaws 722 may include a U-shaped top area comprising two opposite top arms 744 at the top or first end 724 of the jaw 722, and a top space 742 between the top arms 744. The top spaces 742 of the jaws 722 may face one another and jointly provide the aforementioned top opening 740 through which the sealed, dog waste pocket may exit the jaws 722.

As best shown in FIGS. 26 and 27, a bottom, outer skirt 714 may be secured to the distal end 618 of the tube 614 and may substantially conceal the jaws 722 and the sealing members 692. In some embodiments, an underside 716 of the outer skirt 714 may be generally flat and configured to rest against a ground or surface, such as when using the device, or to allow the device to stably stand on a flat surface hands-free.

In some embodiments, movement of the bag sealing mechanism 690 and the lifting mechanism 720 may be independent from another; i.e., transverse opening and closing movement of the sealing members 692 may be independent from the upward and downward, and opening and closing movements of the jaws 722. In such embodiments, the bag sealing mechanism 690 and lifting mechanism 720 may be actuated by separate electrical motors and gear and/or transmission systems, which may be operable from the control head, similarly to previous embodiments. In other embodiments, such as the present embodiment, however, the bag sealing mechanism 690 and lifting mechanism 720 may be interconnected such that their movement is mechanically synchronized and said mechanisms may be, for instance, actuated by a single electric motor (not shown).

Figure 31:
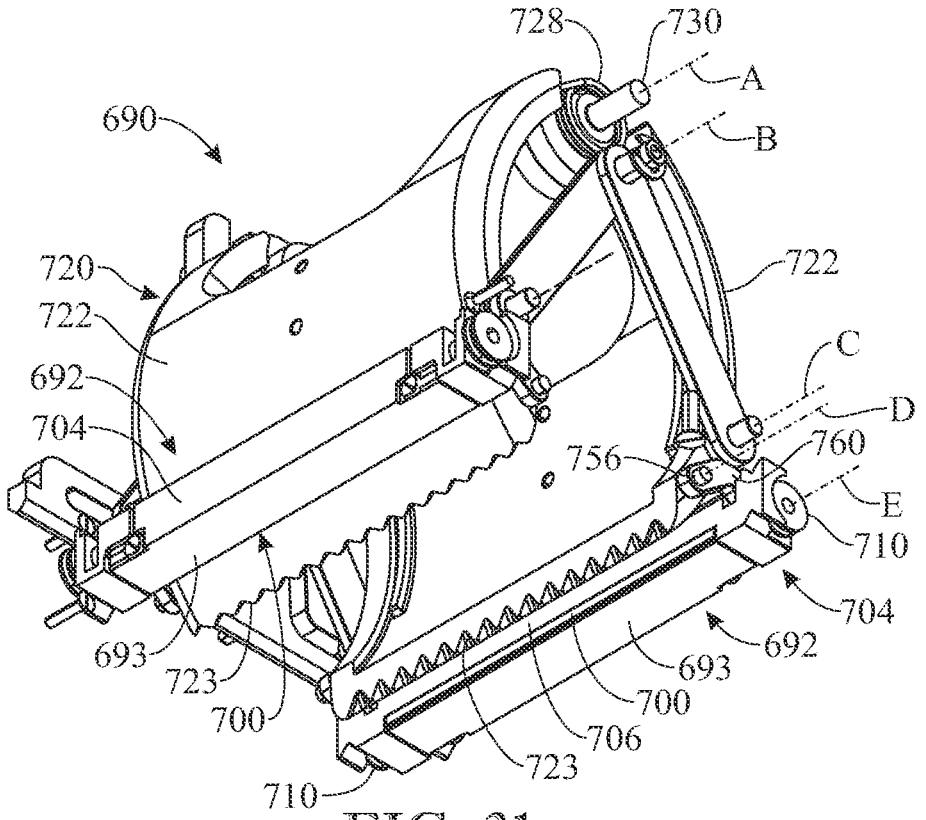
FIG. 31 presents a bottom, side isometric view similar to FIG. 30, where one of the guides has been omitted.
Figure 32:
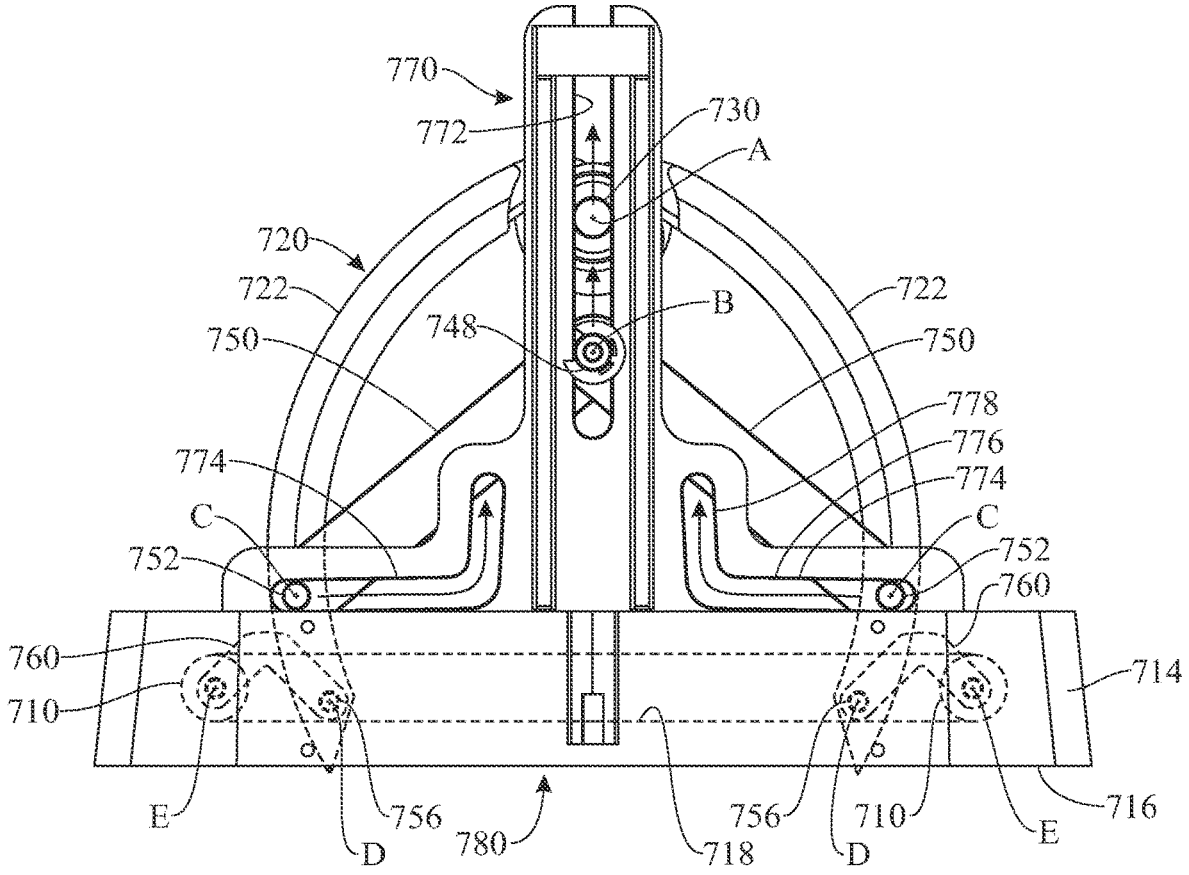
FIG. 32 presents a side elevation view of the distal end of the excrement remover and bagger shown in FIG. 26.

For example, as shown in FIGS. 29, 31 and 32, each top pin 730 extending from a respective end of and coaxially with the hinged connection 728 of the pivotable jaws 722 is linked to a respective, first connecting pin 748 arranged below and spaced apart from, and generally parallel to, the top pin 730. For example, the top pin 730 and corresponding first connecting pin 748 may be interconnected by a band 746, which may be slightly elastically stretchable, allowing for joint translational movement of the top pin 730 and corresponding first connecting pin 748 in a vertical direction, with an optional slight degree of freedom of one relative to the other. The connecting pin 748 pivotably interconnects a pair of jaw links 750. The jaw links 750 may be formed, for instance and without limitation, as elongated rectilinear links or bodies, as shown. The jaw links 750 are pivotable relative to one another about a rotation axis B defined by the first connecting pin 748. At an opposite end of each jaw link 750, the jaw link 750 is pivotably connected to a corresponding one of the jaws 722 by a second connecting pin 752, such that the jaw link 750 and corresponding jaw 722 are pivotably connected about a rotation axis C defined by the second connecting pin 752.

With continued reference to FIGS. 29, 31 and 32, further downward along each jaw 722 and in an area near the bottom end of the jaw 722, a respective third connecting pin 756 pivotably connects the jaw 722 to a sealing member link 760, such that the sealing member link 760 is rotatable relative to the jaw 722 about a rotation axis D defined by the third connecting pin 756. Furthermore, as best shown in FIG. 32, at an opposite end of the sealing member link 760, the sealing member link 760 is rotatably connected to a respective one of the aforementioned rollers 710, such that the roller 710 is rotatable relative to the sealing member link 760 about roller rotation axis E. In some embodiments, such as the present embodiment, the sealing member link 760 may be formed as an angled or curved body.

The five rotation axes A, B, C, D, E described above, each of which is associated to a respective articulated, pivotable or rotatable connection as described heretofore, are parallel to one another and are transversely oriented, i.e. perpendicular to a longitudinal direction of the tube 614. Furthermore, as described above, and further described hereinafter, the five rotation axes A, B, C, D, E are movable in an inter-related manner and in different directions, to enable a sequential and synchronized movement of the lifting mechanism 720 and the bag sealing mechanism 690.

Figure 30:
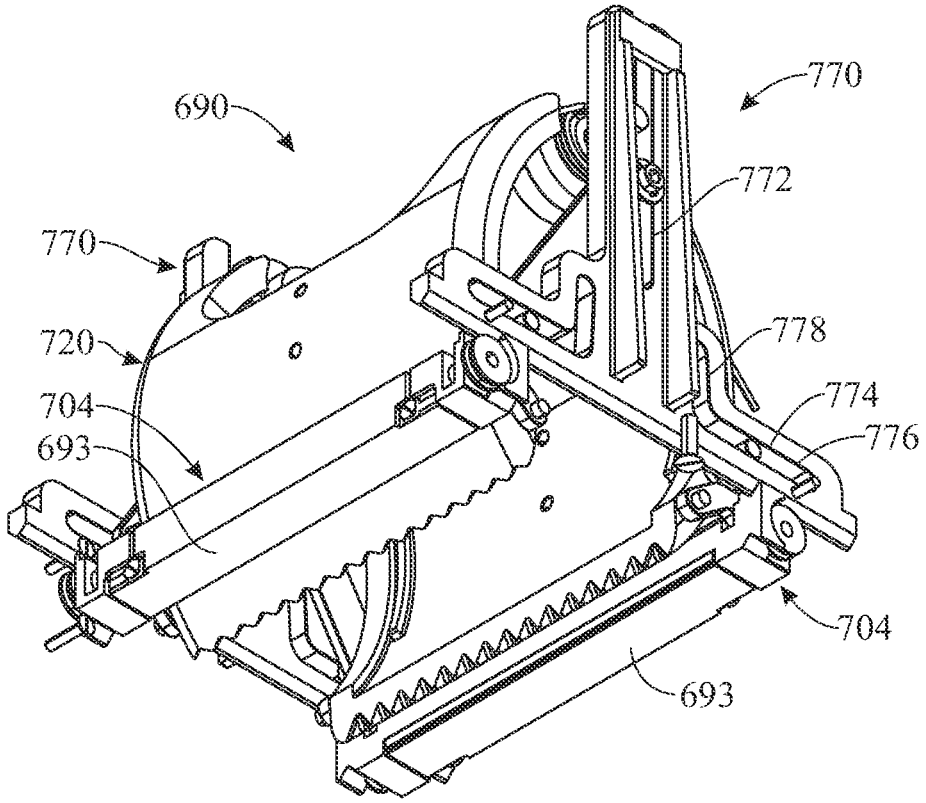
FIG. 30 presents a bottom, side isometric view similar to FIG. 27, where the outer skirt has been omitted.

Specifically, as best shown in FIGS. 28, 30 and 32, the excrement remover and bagger 600 further includes a pair of guides 770 at opposite ends of the jaws 722 and sealing members 692. Each guide 770 may include a vertical channel or slot 772 arranged centrally within the guide 770 and configured to allow for a vertical upward and downward displacement of both the top pin 730 and the first connecting pin 748. Thus, rotation axes A and B are configured to move vertically upward and downward by such guiding of the pins 730, 748 along the vertical slot 772. The guides 770 further include two generally L-shaped channels or slots 774 comprising a generally horizontal, first segment 776 and a generally vertical, second segment 778. Preferably, the first segment 776 is slightly sloped upward towards the second segment 778, and the second segment 778 is slightly sloped inward towards the vertical slot 772. Each L-shaped slot 774 is configured for the displacement therealong of a respective one of the second connecting pins 752. Thus, each rotation axis C is movable along the corresponding L-shaped slot 774. Furthermore, as best shown in FIG. 32, the rollers 710 are configured to roll along a horizontal track or channel 718 formed on an inner side of the skirt 714. Thus, the rotation axis E of each roller 710 is horizontally movable. In turn, the rotation axis D is movable generally analogously to rotation axis C, as axes C and D are arranged at a fixed position relative to one another.

Operation of the excrement remover and bagger 600 is now described with reference to FIGS. 32-36. As shown in FIG. 33, the excrement remover and bagger 600 is initially arranged in an open configuration (also shown in FIG. 32) in which the top and first connecting pins 730 and 748 are arranged at a relatively lower, first position along the vertical slot 772 of the guide 770. Consequently, each second connecting pin 752 is positioned (via the corresponding jaw link 750) at an outermost end of the first segment 776 of the corresponding L-shaped slot 774, and thus the respective jaw 722 is pivoted to an open position. The corresponding roller 710 is forced by the jaws 722 (via the sealing member links 760) to an outermost position along the channels 718 of the outer skirt 714, which causes the sealing members 692 to be displaced outward and arranged generally behind the jaws 722 (i.e. radially outward relative to a central longitudinal axis of the tube 614). In this position, an end opening 780 is formed between the jaws 722. In turn, the flexible elongate element 640 is arranged at an initial position, relatively close to the end opening 780 such that a first or distal end 634 of a flexible elongate sleeve 624 of a disposable bag 612 may be attached to the releasable clamp 644. The flexible elongate sleeve 624 of the disposable bag 612 may then be extended over the bottom end of the excrement remover and bagger 600, and more specifically, over the underside 716 of the outer skirt 714 and extended upward and over the outer surface 628 of the tube 614. In this initial position, a pocket 782 is formed in the flexible elongate sleeve 624, between the releasable clamp 644 and the end opening 780. Next, a user may place the end opening 780 of the excrement remover and bagger 600 over an excrement or deposit **200*a* and move the excrement remover and bagger 600 downward until the deposit 200*a* is received inside the pocket 782 (in some embodiments, the bottom end of the excrement remover and bagger 600** may contact the ground in this initial position).

Figure 33:
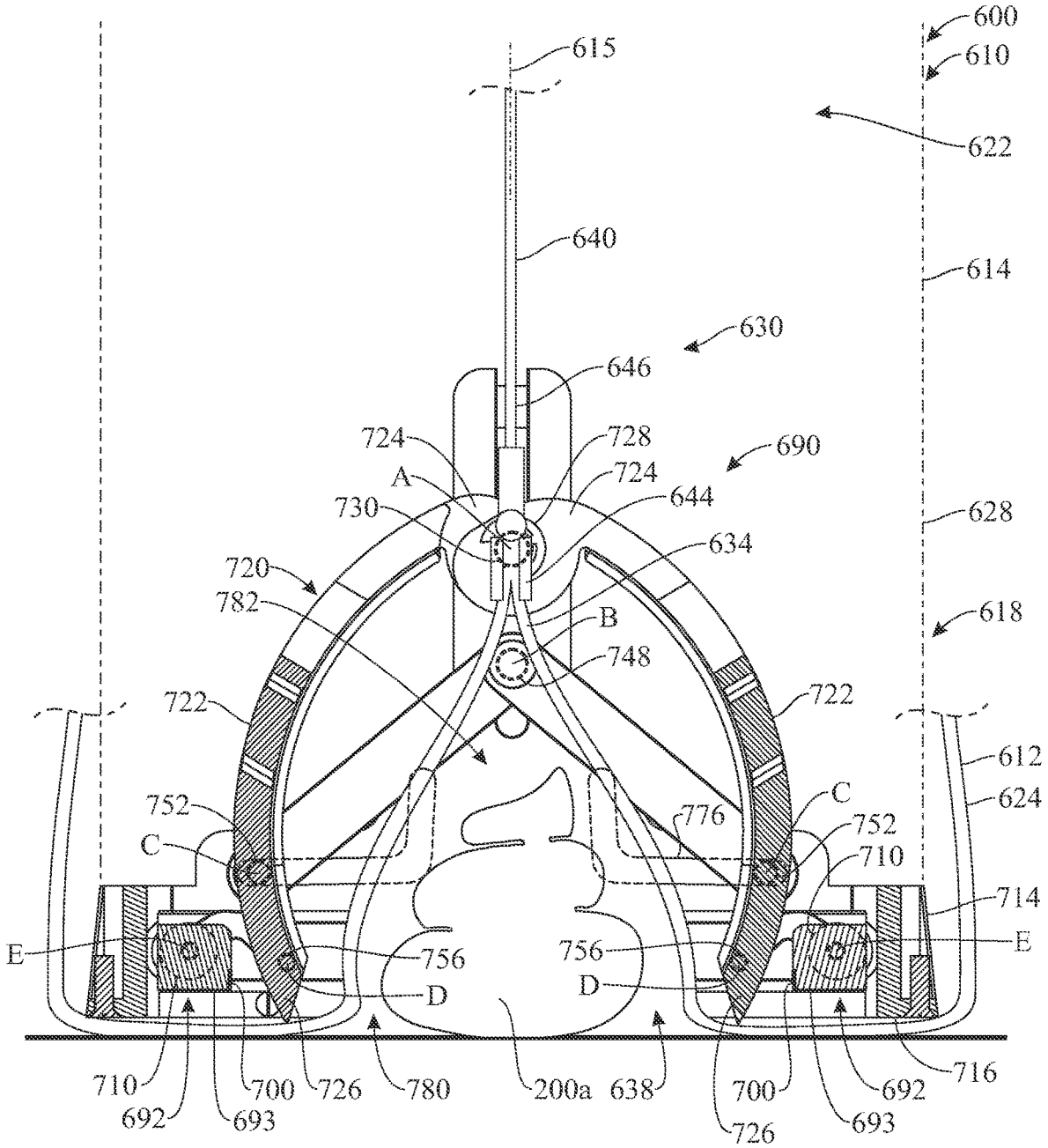
FIG. 33 presents a cross-sectional, side elevation view of the distal end of the excrement remover and bagger shown in FIG. 26.
Figure 34:
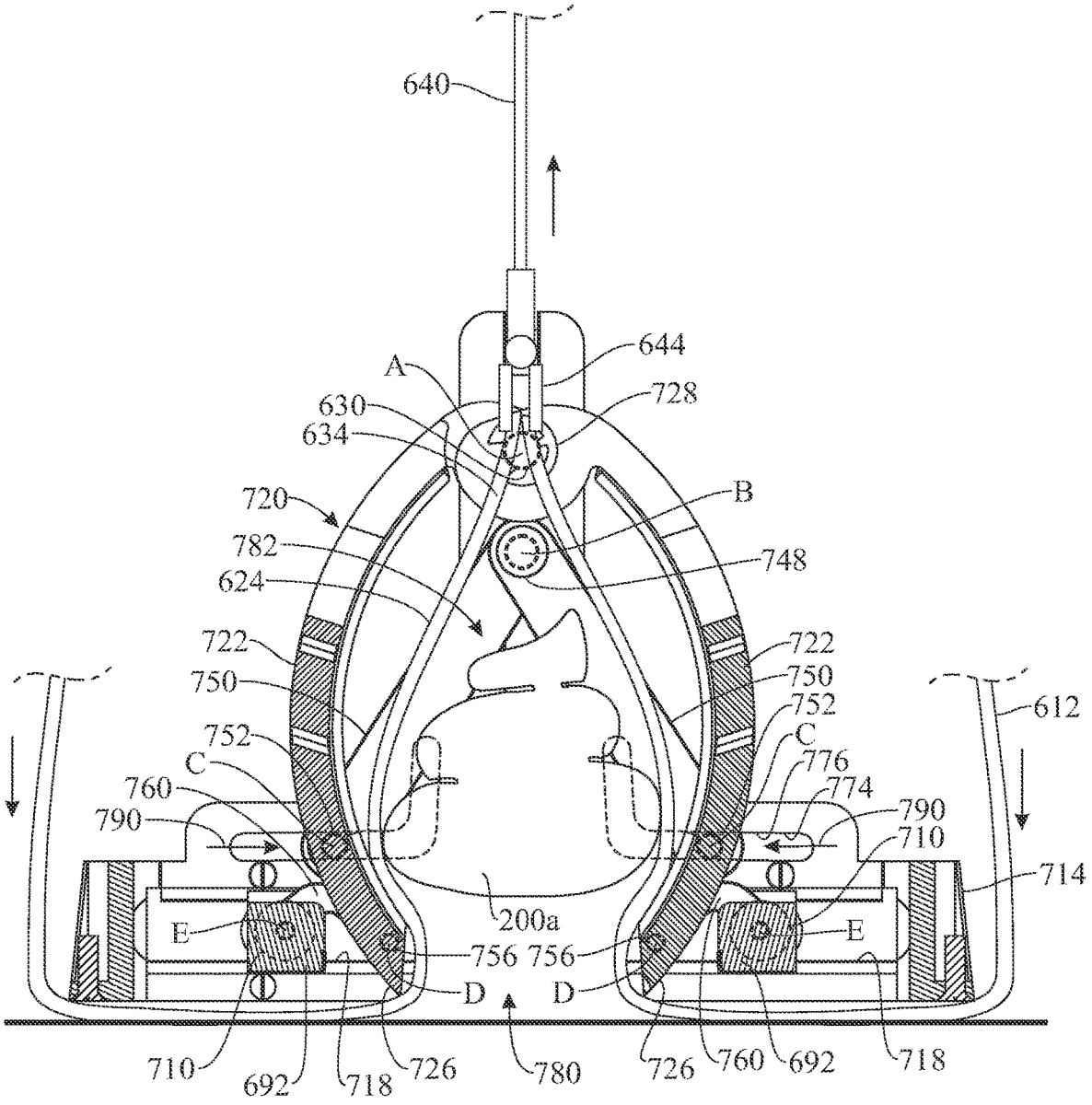
FIG. 34 presents a cross-sectional, side elevation view, similar to the previous figure, where the lifting mechanism is pivoting towards a closed position and the sealing mechanism is being moved towards a sealing position.

From the initial position of FIGS. 32 and 33, a user may manipulate one or more user-operable controls (e.g., activation control 408 described with reference to FIG. 14) on the control head to operate the bag sealing mechanism 690, lifting mechanism 720, and retraction mechanism 630. For this purpose, as mentioned heretofore, one or more motors (e.g., battery-powered motors) and applicable gear and transmission systems may be included in the excrement remover and bagger 600, similarly to previous embodiments. The motor(s) and associated gear and transmission systems may be configured to displace one or more of the pins 730, 748, 752, 756 and rollers 710 and associated rotation axes A, B, C, D, E to cause the synchronized movement of the jaws 722 and sealing members 692 due to the fact that the jaws 722 and sealing members 692 are interconnected at rotation axes D and E by the sealing member links 760. For example, in some embodiments, such as the present embodiment, the motor and gear and transmission system(s) comprised in the device may be configured to drive the first connecting pins 748 to move selectively upward or downward, with the first connecting pins 748 driving the remaining elements via the jaw links 750.

For example, from the initial position of FIGS. 32 and 33, operation of the user-operable controls may drive each first connecting pin 748 upward along the corresponding vertical slot 772 of the respective guide 770. Said upward displacement of the connecting pin 748 along the vertical slot 772 causes the second connecting pins 752 to displace inward along the first segments 776 of the L-shaped slots 774 and the jaw links 750 to pivot towards one another. Inward displacement of the second connecting pins 752 causes the hinged connection 728 to move upward along the vertical slot 772 and the jaws 722 to pivot towards one another about rotation axis A. In turn, as the jaws 722 close, the third connecting pins 756 move inward, towards one another, pulling on the sealing member links 760, which in turn pull the rollers 710 and cause the rollers 710 to roll towards one another along the tracks or channels 718 of the outer skirt 714. I.e., from the initial position of FIGS. 32 and 33, operation of the device causes rotation axes A and B to be displaced upward, rotation axes C, D and E to be displaced inward, the bottom or second ends 726 of the clamps 722 to move generally transversely towards one another, and the sealing members 692 to move generally transversely towards one another, following (or behind) the second ends 726 of the clamps 722. As the jaws 722 begin to close, the second ends 726 of the jaws 722 and the curved or tapered inner surface of the jaws 722 "scoops" the waste deposit **200*a* upward and into the pocket 782**.

In some embodiments, as these aforementioned displacements of the bag sealing mechanism 690 and the lifting mechanism 720 take place, the excrement remover and bagger 600 may also operate the retraction mechanism 630 to start retracting the cable 640 into the tube 614 and thereby pull the clamped, flexible elongate sleeve 624 into the tube 614, to facilitate scooping waste deposits of a larger size.

Figure 35:
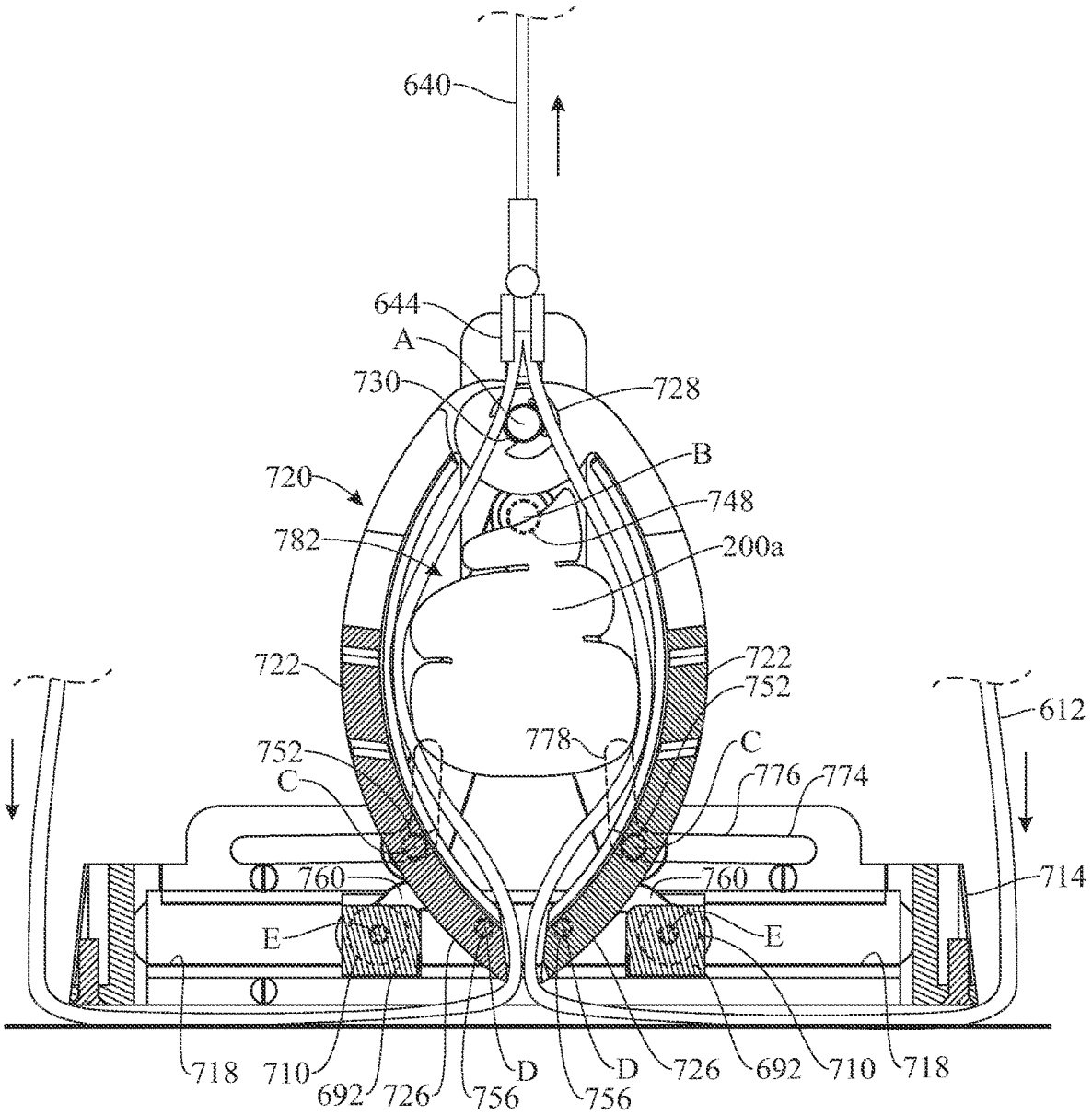
FIG. 35 presents a cross-sectional, side elevation view, similar to the previous figure, where the lifting mechanism has further pivoted towards the closed position and the sealing mechanism has been further moved towards the sealing position.

With reference to FIG. 35, as the first connecting pin 748 continues to be driven upward along the vertical slot 772 of the guide 770, the second connecting pins 752 and rotation axes C continue to displace inward along the first segments 776 of the L-shaped slots 774, and the jaw links 750 pivot further closer to one another. The hinged connection 728 and rotation axis A move further upward along the vertical slot 772 and the jaws 722 pivot further closer one another about rotation axis A. The third connecting pins 756 move inward, towards one another, pulling on the sealing member links 760, which in turn pull the rollers 710 and cause the rollers 710 to roll towards one another along the tracks or channels 718 of the outer skirt 714. I.e., from the initial position of FIGS. 32 and 33, operation of the device causes rotation axes A and B to be displaced upward, rotation axes C, D and E to be displaced inward, the bottom or second ends 726 of the clamps 722 to move generally transversely towards one another, and the sealing members 692 to move generally transversely towards one another, following (or behind) the second ends 726 of the clamps 722. As the jaws 722 begin to close, the second ends 726 of the jaws 722 and the curved or tapered inner surface of the jaws 722 "scoop" the waste deposit 200*a* upward and into the pocket 782. Eventually, as shown in the figure, each second connecting pin 752 reaches the elbow of the L-shaped slot 774; i.e. each second connecting pin 752 reaches the end of the generally transverse first segment 776 and faces the upward, second segment 778. At this point, the second ends 726 of the jaws 772 have been advanced further closer to one another and have brought opposite sides of the flexible elongate sleeve 624 adjacent to one another. The sealing members 692 have also been displaced towards one another in the transverse direction by a pulling force exerted by the jaws 722 on the sealing members 692 via the sealing member links 760, guided by the rollers 710 traveling along the tracks or channels 718.

As shown in FIG. 36, continued upward driving of the first connecting pin 748 along the vertical slot 772 of the guide 770 causes the second connecting pins 752 and rotation axes C to now displace upward along the second segments 778 of the L-shaped slots 774, which in turn forces the top pin 730 and rotation axis B, and thereby the jaws 722, to rise vertically upward. Because the second segments 778 are slightly sloped towards one another, the second connecting pins 752 travel upward along a slightly sloped (non-vertical) trajectory, which causes the rising jaws 722 to further pivot towards one another about the rising, rotation axis B. Eventually, such further pivoting of the jaws 722 about rotation axis B allows the second ends 726 of the jaws 722 to substantially contact one another. In some embodiments, said substantial contact between the second ends 726 of the jaws 722 is configured to sealingly abut the opposite sides of the flexible elongated sleeve 624 against one another to prevent fluids or solids "scooped" into the pocket 782 leaking out of the pocket 782 and towards the sealing members 692.

As further shown in the figure, as the jaws 722 and their rotation axes B have shifted vertically upward, the second ends 726 of the jaws 722 have not only pivoted towards and against one another, but have also risen together with the remainder of the jaws 722 to a position in which the second ends 726 are elevated relative to the sealing members 692, and more particularly, to the heating elements 693. Furthermore, as shown, the third connecting pins 756 and their respective rotation axes D have traveled upward and towards one another, allowing each sealing member link 760 to pivot about the respective rotation axis 1) as indicated by arrows 792, i.e. allowing the rollers 710 to further roll along the channels 718 towards one another until the heating elements 692 substantially contact one another. The heating elements 692 may then be electrically heated to weld the opposite sides of the flexible elongated sleeve 624 to one another to form the aforementioned sealed closure 702.

In other words, the excrement remover and bagger 600 of the present embodiment is configured to first "scoop" the waste deposit into a space inside a bag housed in the tube, while raising the "scooping" mechanism (i.e. the lifting mechanism 720), and then heat weld, or seal, the pocket below the "scooping" mechanism.

Once a waste deposit 200*a* has been scooped and stored in a sealed pocket, the "scooping" process may be repeated with additional dog waste deposits, etc. to form additional dog waste packets 782 along the bag 612 as the bag 612 is pulled into the tube 614. Once each dog waste pocket 782 is formed, the flexible elongate element 640 may pull the pocket 782 upward, from the internal space 734 between the clamps 722, and out of the internal space 734 through the top opening 740 defined in the clamps 722, leaving the internal space 734 ready for the formation of a subsequent pocket 782. Once the walk has been completed, and the disposable bag 612 filled up or the operator simply wishes to dispose of the collected waste in the accumulated packets, the user may operate a string release control (for example, similar to the string release control 406 of FIG. 14), to cause the releasable clamp 644 to disconnect from the disposable bag 612, allowing the bag 612 to slide out of the tube 614 through the distal end 618 thereof.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. An electrically-powered excrement remover and bagger, comprising:

a hollow elongate tube having an interior space, a proximal end, and an open distal end, the tube configured to removably receive a flexible elongate bag in the interior space, with a proximal end of the bag arranged within the interior space and an open, distal end of the bag folded over and arranged outside the tube;

a retraction mechanism including a flexible elongated element, a clamp at a distal end of the flexible elongated element, and a pulling mechanism configured to pull the flexible elongated element and clamp towards a proximal end of the tube, wherein the clamp is configured to removably engage the proximal end of the bag;

a lifting mechanism configured to scoop an excrement off the ground and into the bag; and a bag sealing mechanism configured to form a sealed closure in the bag; wherein the excrement remover and bagger is switchable between:

a first configuration, in which the lifting mechanism defines an end opening for receiving the excrement into an internal space of the lifting mechanism, and the bag sealing mechanism is arranged in a non-sealing position, and a second configuration, in which the lifting mechanism is arranged vertically higher than the bag sealing mechanism and holds the excrement within the internal space of the lifting mechanism, and further in which the bag sealing mechanism is arranged in a sealing position to form said sealed closure and create a sealed pocket along the bag for holding said excrement therein.

2. The excrement remover and bagger of claim 1, wherein the pulling mechanism is configured to pull the flexible elongated element and clamp towards said proximal end of the tube at discrete intervals, and further wherein the excrement remover and bagger is repetitively and reversibly switchable between said first and second configurations as the bag is pulled into the interior space of the tube by the retraction mechanism at said discrete intervals, to create a respective sealed pocket at each interval of said discrete intervals.

3. The excrement remover and bagger of claim 1, wherein the bag sealing mechanism comprises two sealing members movably arranged facing one another and carrying respective heating elements, the sealing members configured to move between said non-sealing position, in which the heating elements are spaced apart from one another, and said sealing position, in which the heating elements are arranged adjacent one another.

4. The excrement remover and bagger of claim 3, wherein the sealing members are located at the open distal end of the tube.

5. The excrement remover and bagger of claim 3, wherein, in the non-sealing position, the heating elements are arranged radially outward of the lifting mechanism relative to a central longitudinal axis of the tube.

6. The excrement remover and bagger of claim 1, wherein the lifting mechanism comprises a pair of jaws, said jaws pivotable relative to one another between an open position in which respective bottom ends of the jaws define the end opening of the lifting mechanism, and a closed position in which the bottom ends of the jaws are adjacent one another, wherein the jaws are arranged in the open position and the closed position when the excrement remover and bagger is in the first configuration and the second configuration, respectively.

7. The excrement remover and bagger of claim 6, wherein the bottom ends of the jaws are configured to fluid-tightly abut opposite sides of the bag onto one another when the jaws are arranged in the closed position.

8. The excrement remover and bagger of claim 6, wherein the bottom ends of the jaws comprise an undulating contour.

9. The excrement remover and bagger of claim 6, wherein the jaws are pivotably connected to one another about a jaw pivoting axis, and the jaws and jaw pivoting axis are vertically movable relative to the tube, and further wherein, in the first configuration, the lifting mechanism is arranged vertically lower than in the second configuration.

10. The excrement remover and bagger of claim 6, wherein the bag sealing mechanism comprises two sealing members movably arranged facing one another and comprising respective heating elements configured to weld opposite sides of the bag to one another to form the sealed closure, wherein each sealing member is articulately connected to a respective jaw of the pair of jaws such that a pivoting of the jaws towards the closed position causes a movement of the respective heating elements towards one another and towards the sealing position.

11. The excrement remover and bagger of claim 10, wherein the sealing members and the bottom ends of the jaws are located at the open distal end of the tube.

12. The excrement remover and bagger of claim 10, wherein each sealing member is articulately connected to the respective jaw by a respective sealing member link, each sealing member link comprising a first articulate connection between said each sealing member link and the respective jaw and a second articulate connection between said each sealing member link and said each sealing member, wherein said each sealing member link is configured to convert a pivoting movement of the respective jaw to a transverse translation of said each sealing member.

13. The excrement remover and bagger of claim 12, wherein each sealing member comprises at least one roller configured to roll along a respective transverse track formed in the tube, and further wherein said second articulated connection articulately connects said at least one roller to said each sealing member link.

14. The excrement remover and bagger of claim 13, the tube comprising an outer skirt at the open distal end, the skirt comprising a generally flat underside configured to stably rest on a flat surface, wherein the transverse tracks are comprised in the skirt.

15. The excrement remover and bagger of claim 12, wherein the jaws are pivotably connected to one another about a jaw pivoting axis, and the jaws and jaw pivoting axis are vertically movable relative to the tube, and further wherein, in the first configuration, the lifting mechanism is arranged vertically lower than in the second configuration, wherein the excrement remover and bagger further comprises a guide, the guide comprising a vertical slot configured to vertically guide the jaw pivoting axis.

16. The excrement remover and bagger of claim 15, further comprising a pair of jaw links, the jaw links articulately connected to one another about a rotation axis arranged in vertical registration and below the jaw rotation axis, wherein each jaw link is further articulately connected to a respective jaw of the pair of jaws by a respective articulate connection.

17. The excrement remover and bagger of claim 16, the guide further comprising a pair of L-shaped slots, each L-shaped slot comprising a generally transverse, first segment, and a generally longitudinal, second segment extending from the first segment, each L-shaped slot configured to guide the respective articulate connection between a respective jaw of the pair of jaws and a respective jaw link of the pair of jaw links.

18. The excrement remover and bagger of claim 17, wherein the first segment is sloped towards the jaw rotation axis, and the second segment is sloped towards a central longitudinal axis of the tube.

19. An electrically-powered excrement remover and bagger, comprising:

a hollow elongate tube having an interior space, a proximal end, and an open distal end, the tube configured to removably receive a flexible elongate bag in the interior space, with a proximal end of the bag arranged within the interior space and an open, distal end of the bag folded over and arranged outside the tube;

a retraction mechanism including a flexible elongated element, a clamp at a distal end of the flexible elongated element, and a pulling mechanism configured to pull the flexible elongated element and clamp towards a proximal end of the tube, wherein the clamp is configured to removably engage the proximal end of the bag;

a lifting mechanism configured to scoop an excrement off the ground and into the bag, the lifting mechanism comprising a pair of jaws, said jaws pivotable relative to one another between an open position in which respective bottom ends of the jaws define an end opening of the lifting mechanism, and a closed position in which the bottom ends of the jaws are adjacent one another; and a bag sealing mechanism configured to form a sealed closure in the bag, the bag sealing mechanism comprising two sealing members movably arranged facing one another and carrying respective heating elements, the sealing members configured to move between a non-sealing position, in which the heating elements are spaced apart from one another, and a sealing position, in which the heating elements are arranged adjacent one another; wherein the excrement remover and bagger is switchable between:

a first configuration, in which the pair of jaws of the lifting mechanism are arranged in the open position defining and said end opening allows receiving the excrement into an internal space between the pair of jaws, and the bag sealing mechanism is arranged in the non-sealing position, and a second configuration, in which the lifting mechanism is arranged vertically higher than the bag sealing mechanism and the pair of jaws are arranged in the closed position and hold the excrement within the internal space between the pair of jaws, with bottom ends of the jaws fluid-tightly abutting opposite sides of the bag located beneath the internal space onto one another, and further in which the bag sealing mechanism is arranged in the sealing position to form said sealed closure and create a sealed pocket along the bag for holding said excrement therein.

20. An electrically-powered excrement remover and bagger, comprising:

a hollow elongate tube having an interior space, a proximal end, and an open distal end, the tube configured to removably receive a flexible elongate bag in the interior space, with a proximal end of the bag arranged within the interior space and an open, distal end of the bag folded over and arranged outside the tube;

a retraction mechanism including a flexible elongated element, a clamp at a distal end of the flexible elongated element, and a pulling mechanism configured to pull the flexible elongated element and clamp towards a proximal end of the tube, wherein the clamp is configured to removably engage the proximal end of the bag, a lifting mechanism configured to scoop an excrement off the ground and into the bag, the lifting mechanism comprising a pair of jaws, said jaws pivotable relative to one another between an open position in which respective bottom ends of the jaws define an end opening of the lifting mechanism, and a closed position in which the bottom ends of the jaws are adjacent one another; and a bag sealing mechanism configured to form a sealed closure in the bag, the bag sealing mechanism comprising two sealing members movably arranged facing one another and carrying respective heating elements, the sealing members configured to move between a non-sealing position, in which the heating elements are spaced apart from one another, and a sealing position, in which the heating elements are arranged adjacent one another; wherein the excrement remover and bagger is switchable between:

a first configuration, in which the pair of jaws of the lifting mechanism are arranged in the open position defining and said end opening allows receiving the excrement into an internal space between the pair of jaws, and the bag sealing mechanism is arranged in the non-sealing position, and a second configuration, in which the lifting mechanism is arranged vertically higher than the bag sealing mechanism and the pair of jaws are arranged in the closed position and hold the excrement within the internal space between the pair of jaws, with bottom ends of the jaws fluid-tightly abutting opposite sides of the bag located beneath the internal space onto one another, and further in which the bag sealing mechanism is arranged in the sealing position to form said sealed closure and create a sealed pocket along the bag for holding said excrement therein: wherein the pulling mechanism is configured to pull the flexible elongated element and clamp towards said proximal end of the tube at discrete intervals, and further wherein the excrement remover and bagger is repetitively and reversibly switchable between said first and second configurations as the bag is pulled into the interior space of the tube by the retraction mechanism at said discrete intervals, to create a respective sealed pocket at each interval of said discrete intervals.

* * * * *